US008689671B2

(12) United States Patent
Hummel et al.

(10) Patent No.: US 8,689,671 B2
(45) Date of Patent: Apr. 8, 2014

(54) LIGHTWEIGHT ARMOR AND METHODS OF MAKING

(75) Inventors: Alan R. Hummel, Winchester, VA (US); David J. Kraft, Howell, MI (US); Terry L. Shirley, Stephens City, VA (US); William F. Brown, Columbus, IN (US); Ray K. Orndorff, Middletown, VA (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 667 days.

(21) Appl. No.: 11/862,441

(22) Filed: Sep. 27, 2007

(65) Prior Publication Data

US 2012/0174747 A1 Jul. 12, 2012

Related U.S. Application Data

(60) Provisional application No. 60/848,498, filed on Sep. 29, 2006.

(51) Int. Cl.
*F41H 5/02* (2006.01)

(52) U.S. Cl.
USPC ..... 89/36.02; 89/36.01; 89/36.07; 428/300.7; 428/301.1

(58) Field of Classification Search
USPC ..... 89/36.01, 36.02, 36.05, 36.07, 36.09; 428/301.1
See application file for complete search history.

(56) References Cited

U.S. PATENT DOCUMENTS

| | | | |
|---|---|---|---|
| 287,918 | A | 11/1883 | Fish |
| 572,965 | A | 12/1896 | Courtney |
| 1,536,524 | A | 5/1925 | Pfersdorff |
| 2,399,184 | A | 4/1946 | Heckert |
| 3,549,427 | A | 12/1970 | Rausch et al. |
| 3,649,342 | A | 3/1972 | Bartlett |
| 3,649,426 | A | 3/1972 | Gates, Jr. |
| 3,674,547 | A | 7/1972 | Noone |
| 3,722,355 | A | 3/1973 | King |
| 3,802,933 | A | 4/1974 | Rausch et al. |
| 3,807,970 | A | 4/1974 | Greene |
| 3,826,172 | A | 7/1974 | Dawson |
| 3,828,699 | A | 8/1974 | Bowen |
| 3,856,120 | A | 12/1974 | Kwolek et al. |
| 3,859,892 | A | 1/1975 | Coes |
| 3,873,998 | A | 4/1975 | Norris et al. |

(Continued)

FOREIGN PATENT DOCUMENTS

| | | |
|---|---|---|
| EP | 0287918 | 10/1988 |
| EP | 0572965 | 12/1993 |

(Continued)

*Primary Examiner* — J. Woodson Eldred

(74) *Attorney, Agent, or Firm* — Robert L. Stearns; Dickinson Wright, PLLC

(57) ABSTRACT

An article of armor includes a friction material operative to prevent penetration of a ballistic projectile. The armor is also operative to prevent penetration of a plurality of ballistic projectiles at a single point of impact. The armor may include a backing, or a facing, or may comprise an intermediate layer between a backing and facing in any combination. The armor of the invention applied directly to or attached to an article to be armored so as to cover all or any portion of the article. The backing and facing may include a friction material or a non-friction material. The friction material is a composite of a resin binder agent, a fibrous support structure, a friction modifier system, and a wear system.

28 Claims, 8 Drawing Sheets

(56) References Cited

U.S. PATENT DOCUMENTS 3,898,729 A 8/1975 Greene
3,916,060 A 10/1975 Fish et al.
3,971,072 A 7/1976 Armellino
3,977,294 A 8/1976 Jahn
3,988,780 A 11/1976 Armellino
3,998,573 A 12/1976 Gilbert et al.
4,034,138 A 7/1977 Babayan
4,090,005 A 5/1978 Morgan
4,119,591 A 10/1978 Aldrich
4,145,223 A 3/1979 Iwata
4,178,278 A 12/1979 Reynolds, Jr.
4,179,979 A 12/1979 Cook et al.
4,182,437 A 1/1980 Roberts et al.
4,186,648 A 2/1980 Clausen et al.
4,193,956 A 3/1980 Kalnins
4,218,361 A 8/1980 Searfoss et al.
4,219,452 A 8/1980 Littlefield
4,226,758 A 10/1980 Sumira
4,235,762 A 11/1980 Jinkins et al.
4,236,441 A 12/1980 Turner et al.
4,273,405 A 6/1981 Law
4,292,882 A 10/1981 Clausen
4,313,869 A 2/1982 Littlefield
4,323,000 A 4/1982 Dennis et al.
4,337,981 A 7/1982 Meinke
4,345,175 A 8/1982 Jones
4,352,750 A 10/1982 Eschen
4,388,423 A 6/1983 Kaufman et al.
4,390,583 A 6/1983 Brazel
4,403,012 A 9/1983 Harpell et al.
4,405,137 A 9/1983 Webb
4,432,922 A 2/1984 Kaufman et al.
4,457,985 A 7/1984 Harpell et al.
4,461,643 A 7/1984 Kaufman
4,476,256 A 10/1984 Hamermesh
4,487,729 A 12/1984 Kaufman
4,505,441 A 3/1985 Kirsh et al.
4,517,321 A 5/1985 Gardner et al.
4,537,823 A 8/1985 Tsang et al.
4,545,286 A 10/1985 Fedij
4,579,885 A 4/1986 Domeier et al.
4,604,249 A 8/1986 Luhleich et al.
4,605,595 A 8/1986 Tsang et al.
4,613,535 A 9/1986 Harpell et al.
4,617,165 A 10/1986 Tsang et al.
4,623,574 A 11/1986 Harpell et al.
4,644,866 A 2/1987 Sullivan
4,650,710 A 3/1987 Harpell et al.
4,656,203 A 4/1987 Parker
4,700,630 A 10/1987 Sullivan
4,732,803 A 3/1988 Smith, Jr.
4,737,401 A 4/1988 Harpell et al.
4,737,402 A 4/1988 Harpell et al.
4,739,690 A 4/1988 Moskowitz
4,748,064 A 5/1988 Harpell et al.
4,772,950 A 9/1988 Furuhata et al.
4,775,705 A 10/1988 Parker et al.
4,792,361 A 12/1988 Double et al.
4,799,977 A 1/1989 Rausch
4,822,657 A 4/1989 Simpson
4,829,904 A 5/1989 Sullivan
4,832,995 A 5/1989 McLauchlin
4,842,923 A 6/1989 Hartman
4,858,245 A 8/1989 Sullivan et al.
4,859,541 A 8/1989 Maxeiner et al.
4,868,040 A 9/1989 Hallal et al.
4,869,974 A 9/1989 Oskarsson et al.
4,876,941 A 10/1989 Barnes et al.
4,879,165 A 11/1989 Smith
4,889,836 A 12/1989 Buljan et al.
4,893,815 A 1/1990 Rowan
4,897,117 A 1/1990 Penrice
4,916,000 A 4/1990 Li et al.
4,923,747 A 5/1990 McCullough, Jr. et al.
4,934,245 A 6/1990 Musante et al.
4,953,234 A 9/1990 Li et al.
4,965,138 A 10/1990 Gonzalez
4,969,386 A 11/1990 Sandstrom et al.
4,994,506 A 2/1991 Anton et al.
5,006,390 A 4/1991 Kavesh et al.
5,007,326 A 4/1991 Gooch, Jr. et al.
5,020,411 A 6/1991 Rowan
5,035,764 A 7/1991 Blake
5,045,371 A 9/1991 Calkins
5,059,490 A 10/1991 Brupbacher et al.
5,060,553 A 10/1991 Jones
5,061,545 A 10/1991 Li et al.
5,067,388 A 11/1991 Crews et al.
5,078,031 A 1/1992 Buljan et al.
5,083,643 A 1/1992 Hummel et al.
5,083,650 A 1/1992 Seiz et al.
5,112,667 A 5/1992 Li et al.
5,119,512 A 6/1992 Dunbar et al.
5,122,420 A 6/1992 Baron et al.
5,132,065 A 7/1992 Christie
5,145,888 A 9/1992 Gong et al.
5,160,776 A 11/1992 Li et al.
5,164,536 A 11/1992 Barbaza et al.
5,167,876 A 12/1992 Lem et al.
5,175,040 A 12/1992 Harpell et al.
5,177,124 A 1/1993 Questel et al.
5,190,991 A 3/1993 Parker et al.
5,215,813 A 6/1993 Hartman et al.
5,279,777 A 1/1994 Kojima et al.
5,320,904 A 6/1994 Mitchell
5,325,941 A 7/1994 Farinacci et al.
5,330,820 A 7/1994 Li et al.
5,339,931 A 8/1994 Jacko et al.
5,343,796 A * 9/1994 Cordova et al. ..... 89/36.02
5,344,854 A 9/1994 Ohya et al.
5,349,893 A 9/1994 Dunn
5,354,605 A 10/1994 Lin et al.
5,361,678 A 11/1994 Roopchand et al.
5,364,700 A 11/1994 Domeier
5,375,476 A 12/1994 Gray
5,383,567 A 1/1995 Sorathia et al.
5,383,963 A 1/1995 Kobayashi et al.
5,394,786 A 3/1995 Gettle et al.
5,407,612 A 4/1995 Gould et al.
5,421,087 A 6/1995 Newkirk et al.
5,440,965 A 8/1995 Cordova et al.
5,440,995 A 8/1995 Levitt
5,443,917 A 8/1995 Tarry
5,460,883 A 10/1995 Barber, Jr. et al.
5,471,905 A 12/1995 Martin
5,480,706 A 1/1996 Li et al.
5,515,541 A 5/1996 Sacks et al.
5,515,950 A 5/1996 Kwolek
5,516,595 A 5/1996 Newkirk et al.
5,516,816 A 5/1996 Samuels
5,520,866 A 5/1996 Kaminski et al.
5,535,860 A 7/1996 Hummel et al.
5,552,208 A 9/1996 Lin et al.
5,554,816 A 9/1996 Skaggs et al.
5,567,498 A 10/1996 McCarter et al.
5,576,358 A 11/1996 Lem et al.
5,587,230 A 12/1996 Lin et al.
5,591,933 A 1/1997 Li et al.
5,614,305 A 3/1997 Paine et al.
5,676,577 A 10/1997 Lam et al.
5,677,029 A 10/1997 Prevorsek et al.
5,686,689 A 11/1997 Snedeker et al.
5,690,526 A 11/1997 Lin et al.
5,706,382 A 1/1998 Smith
5,733,643 A 3/1998 Green
5,736,474 A 4/1998 Thomas
5,738,925 A 4/1998 Chaput
5,763,813 A 6/1998 Cohen et al.
5,776,839 A 7/1998 Dischler et al.
5,789,327 A 8/1998 Rousseau
5,796,028 A 8/1998 Field et al.
5,804,757 A 9/1998 Wynne
5,817,411 A 10/1998 Nakajima
5,817,433 A 10/1998 Darras

(56) References Cited

U.S. PATENT DOCUMENTS 5,824,940 A 10/1998 Chediak et al.
5,840,132 A 11/1998 Erdemir et al.
5,857,215 A 1/1999 Fergason et al.
5,861,203 A 1/1999 Yuan et al.
5,889,080 A 3/1999 Kaminski et al.
5,889,082 A 3/1999 Kaminski et al.
5,891,933 A 4/1999 Kesavan et al.
5,919,837 A 7/1999 Kaminski et al.
5,920,671 A 7/1999 Smith
5,922,986 A 7/1999 Wanninger et al.
5,970,843 A 10/1999 Strasser et al.
5,971,113 A 10/1999 Kesavan et al.
6,003,424 A 12/1999 Cordova et al.
6,013,146 A 1/2000 Yuan et al.
6,020,057 A 2/2000 Darras
6,022,502 A 2/2000 Lockhart et al.
6,029,269 A 2/2000 El-Soudani
6,048,593 A 4/2000 Espeland et al.
6,051,646 A 4/2000 Nass et al.
6,080,230 A 6/2000 Sasaki et al.
6,082,931 A 7/2000 Hopper
6,098,193 A 8/2000 Itoi
6,099,683 A 8/2000 Meier et al.
6,107,386 A 8/2000 Nakajima et al.
6,110,991 A 8/2000 Kaminski et al.
6,111,534 A 8/2000 Escarmant
6,112,635 A 9/2000 Cohen
6,127,291 A 10/2000 Coppage, Jr. et al.
6,135,006 A 10/2000 Strasser et al.
6,140,388 A 10/2000 Nass et al.
6,146,600 A 11/2000 Williamson
6,167,992 B1 1/2001 Torpey et al.
6,183,834 B1 2/2001 van der Loo
6,190,761 B1 2/2001 Sasaki et al.
6,220,405 B1 4/2001 Kesavan et al.
6,228,815 B1 5/2001 Kesavan
6,231,921 B1 5/2001 Hashemzadeh et al.
6,248,676 B1 6/2001 Dischler
6,260,674 B1 7/2001 Arai
6,265,356 B1 7/2001 Sugai
6,271,162 B1 8/2001 Haug et al.
6,276,254 B1 8/2001 Cordova et al.
6,276,255 B1 8/2001 Field et al.
6,284,815 B1 9/2001 Sasahara et al.
6,289,781 B1 9/2001 Cohen
6,298,957 B1 10/2001 Haug et al.
6,309,732 B1 10/2001 Lopez-Anido et al.
6,314,858 B1 11/2001 Strasser et al.
6,316,083 B1 11/2001 Kawabata et al.
6,327,954 B1 12/2001 Medlin
6,377,246 B1 4/2002 Wild
6,403,210 B1 6/2002 Stuivinga et al.
6,408,733 B1 6/2002 Perciballi
6,408,734 B1 6/2002 Cohen
6,418,832 B1 7/2002 Colvin
6,423,389 B1 7/2002 Yoshie
6,449,769 B1 9/2002 Bachner, Jr.
6,467,557 B1 10/2002 Krueger et al.
6,474,453 B2 11/2002 Sano
6,475,614 B2 11/2002 Hikichi
6,485,446 B1 11/2002 Brother et al.
6,497,966 B2 12/2002 Cohen
6,502,674 B2 1/2003 Rheinheimer et al.
6,532,857 B1 3/2003 Shih et al.
6,544,624 B1 4/2003 Lopez-Anido et al.
6,546,838 B2 4/2003 Zavitsanos et al.
6,575,075 B2 6/2003 Cohen
6,579,920 B2 6/2003 Burnett et al.
6,581,504 B2 6/2003 Caron
6,609,452 B1 8/2003 McCormick et al.
6,612,217 B1 9/2003 Shockey et al.
6,612,415 B2 9/2003 Yamane
6,612,617 B2 9/2003 Xu
6,630,416 B1 10/2003 Lam et al.
6,632,857 B1 10/2003 Nakajima et al.
6,635,357 B2 10/2003 Moxson et al.
6,641,893 B1 11/2003 Suresh et al.
6,642,159 B1 11/2003 Bhatnagar et al.
6,670,408 B2 12/2003 Hikichi et al.
6,679,157 B2 1/2004 Chu et al.
6,679,176 B1 1/2004 Zavitsanos et al.
6,681,400 B1 1/2004 Mills
6,681,403 B2 1/2004 Lyden
6,698,024 B2 3/2004 Graves et al.
6,704,934 B2 3/2004 Graham et al.
6,709,736 B2 3/2004 Gruber et al.
6,718,861 B1 4/2004 Anderson, Jr. et al.
6,737,158 B1 5/2004 Thompson
6,787,204 B2 9/2004 Chaussade et al.
6,805,034 B1 10/2004 McCormick et al.
6,825,137 B2 11/2004 Fu et al.
6,826,996 B2 12/2004 Strait
6,841,492 B2 1/2005 Bhatnagar et al.
6,846,548 B2 1/2005 Harpell et al.
6,846,758 B2 1/2005 Bhatnagar et al.
6,862,970 B2 3/2005 Aghajanian et al.
6,863,968 B2 3/2005 Nagata et al.
6,886,473 B2 5/2005 Marchiori et al.
6,892,392 B2 5/2005 Crye et al.
6,895,851 B1 5/2005 Adams et al.
6,908,660 B2 6/2005 Bauer et al.
6,919,127 B2 7/2005 Waggoner et al.
6,945,155 B2 9/2005 Cordova et al.
6,951,162 B1 10/2005 Shockey et al.
6,955,112 B1 10/2005 Adams et al.
6,962,739 B1 11/2005 Kim et al.
6,995,103 B2 2/2006 Aghajanian
7,003,803 B1 2/2006 Lyden
7,026,038 B2 4/2006 Franzoi et al.
7,026,045 B2 4/2006 Rettenbacher et al.
7,037,865 B1 5/2006 Kimberly
7,067,031 B2 6/2006 deWitt
7,073,538 B2 7/2006 Bhatnagar et al.
7,077,048 B1 7/2006 Anderson, Jr. et al.
7,082,868 B2 8/2006 Reichman
7,104,177 B1 9/2006 Aghajanian et al.
7,107,623 B2 9/2006 Hatch et al.
7,117,780 B2 10/2006 Cohen
7,128,963 B2 10/2006 Benitsch
7,628,104 B2 * 12/2009 Warren et al. ..... 89/36.02
7,749,568 B2 * 7/2010 Schmidt ..... 427/333
7,825,048 B2 * 11/2010 Wang et al. ..... 442/135
7,845,266 B2 * 12/2010 Duke et al. ..... 89/36.04
2002/0012768 A1 1/2002 Cohen
2002/0037391 A1 3/2002 Harpell et al.
2002/0088340 A1 7/2002 Chu et al.
2002/0094406 A1 7/2002 Cohen
2002/0146545 A1 10/2002 Franzoi et al.
2002/0188997 A1 12/2002 Lyden
2003/0138615 A1 7/2003 Gruber et al.
2003/0167910 A1 9/2003 Strait
2003/0180579 A1 9/2003 Waggoner et al.
2003/0199215 A1 10/2003 Bhatnagar et al.
2004/0020353 A1 2/2004 Ravid et al.
2004/0040462 A1 3/2004 Marchiori et al.
2004/0083880 A1 5/2004 Cohen
2004/0092183 A1 5/2004 Geva et al.
2004/0118271 A1 6/2004 Puckett et al.
2004/0165957 A1 8/2004 Serrano et al.
2004/0180181 A1 9/2004 Franzoi et al.
2004/0197542 A1 10/2004 Benitsch
2004/0213982 A1 10/2004 Touzov
2004/0216593 A1 11/2004 Pastrnak et al.
2005/0011347 A1 1/2005 Muller, Jr.
2005/0019543 A1 1/2005 Lyles
2005/0066805 A1 3/2005 Park et al.
2005/0067816 A1 3/2005 Buckman
2005/0072294 A1 4/2005 Cohen
2005/0082330 A1 4/2005 Fehlberg et al.
2005/0087064 A1 4/2005 Cohen
2005/0119104 A1 6/2005 Alexander et al.
2005/0170221 A1 8/2005 Kim et al.
2005/0211086 A1 9/2005 Mayseless
2005/0281999 A1 12/2005 Hofmann et al.

(56) References Cited

U.S. PATENT DOCUMENTS

| | | | | |
|---|---|---|---|---|
| 2005/0282007 | A1 | 12/2005 | Sauer et al. | |
| 2005/0282450 | A1 | 12/2005 | Sauer et al. | |
| 2006/0013977 | A1 | 1/2006 | Duke et al. | |
| 2006/0037463 | A1 | 2/2006 | Vittoser et al. | |
| 2006/0065111 | A1 | 3/2006 | Henry | |
| 2006/0078749 | A1 | 4/2006 | Grau et al. | |
| 2006/0105183 | A1 | 5/2006 | Chu et al. | |
| 2006/0141237 | A1 | 6/2006 | Leighton et al. | |
| 2006/0145007 | A1 | 7/2006 | Melberg et al. | |
| 2006/0147691 | A1 | 7/2006 | Rockenfeller et al. | |
| 2006/0157901 | A1 | 7/2006 | Vito et al. | |
| 2006/0162537 | A1 | 7/2006 | Anderson, Jr. et al. | |
| 2006/0162539 | A1 | 7/2006 | Fucke et al. | |
| 2006/0168710 | A1 | 8/2006 | Vito et al. | |
| 2006/0169128 | A1 | 8/2006 | Aghajanian et al. | |
| 2006/0210749 | A1 | 9/2006 | Geva et al. | |
| 2006/0213360 | A1 | 9/2006 | Ravid et al. | |
| 2006/0249012 | A1 | 11/2006 | Sarva et al. | |
| 2006/0252325 | A1 | 11/2006 | Matsumura et al. | |
| 2006/0269738 | A1 | 11/2006 | Kimberly | |
| 2008/0264243 | A1* | 10/2008 | Lucuta et al. ..... | 89/36.02 |
| 2009/0114083 | A1* | 5/2009 | Moore et al. ..... | 89/36.02 |

FOREIGN PATENT DOCUMENTS

| | | | |
|---|---|---|---|
| EP | 0790624 | | 8/1997 |
| EP | 1030020 | | 8/2000 |
| GB | 2260600 | | 4/1993 |
| JP | 02501997 | A | 7/1990 |
| JP | 07012159 | A | 1/1995 |
| JP | 7243796 | A | 9/1995 |
| JP | 08061896 | A | 3/1996 |
| JP | 10512842 | A | 12/1998 |
| JP | 11108594 | A | 4/1999 |
| JP | 2005075864 | A | 3/2005 |
| RU | 2001056 | C1 | 12/1991 |
| RU | 2080544 | C1 | 5/1997 |
| RU | 42887 | U1 | 8/2004 |
| RU | 2004137113 | A | 9/2005 |
| WO | WO9740205 | | 10/1997 |
| WO | WO9954235 | | 10/1999 |
| WO | WO0210667 | | 2/2002 |
| WO | WO03091588 | | 11/2003 |
| WO | WO2005054905 | | 6/2005 |
| WO | WO2006009970 | | 1/2006 |
| WO | WO2006019771 | | 2/2006 |
| WO | WO2006031933 | | 3/2006 |
| WO | WO2006083309 | | 8/2006 |

* cited by examiner

LIGHTWEIGHT ARMOR AND METHODS OF MAKING

CROSS-REFERENCES TO RELATED APPLICATIONS

This patent application claims priority to us provisional patent application Ser. No. 60/848,498 filed Sep. 29, 2006, which is incorporated herein by reference in its entirety.

BACKGROUND OF THE INVENTION

1. Technical Field

This invention relates generally to armors. More particularly, it relates to the use of friction materials as armor.

2. Related Art

Ballistic armor is used in many forms and many applications, including both structural and non-structural applications, for protecting all manner of items from damage due to impact from all manner of ballistic projectiles. The applications include buildings and other structures, all manner of combat and non-combat vehicles, personnel and other applications. For example, historically, combat and non-combat structures and vehicles were protected by heavy metallic armors made from, for example, iron or high alloy steels. As more powerful and sophisticated armor-piercing projectiles were developed, armors made from these conventional materials had to be made more resistant to penetration. This was generally achieved by making the armor thicker and more resistant to impact and penetration, which generally had the disadvantage of making the armor heavier. Examples of existing armor types may be found in various military specifications, such as those which exist for cold-rolled iron and steel, wrought and other types of armor in varying thicknesses.

In response to the development of sophisticated armor-piercing ballistic projectiles and the need for armor which could be used in applications requiring reduced weight, such as various types of aircraft, stronger but lighter types of armor materials have been developed and used. For example, Ti-6Al-4V (nominally 6 weight percent aluminum, 4 weight percent vanadium, balance essentially titanium) combines good penetration resistance and lower density than iron-based armors and, therefore, has been widely used as an armor material. This alloy, which is relatively lightweight, absorbs the energy of a projectile by spreading the energy out across its mass, thereby blunting the tip of the projectile and resisting penetration. As an example, US military specification MIL-DTL-46077F NOT 1 sets forth the military requirements for titanium alloy armor. Various improvements to and modifications of the composition and metallurgical properties and morphology of titanium-based armors have been proposed.

Relatively recently, conventional armors and lightweight armors, including titanium-based armors, have been thwarted by advanced armor-piercing rounds designed to concentrate their energy within a very small area that may melt the armor material. In response, high temperature ceramic-based armors have been developed. Ceramics are used in the fabrication of armors because they typically have high melting points and good high temperature strength and toughness, as well as being relatively lightweight and extremely hard materials. As an example, US military specification MIL-P-46199P NOT 1 specifies the requirements for alumina plate armor. One of the limitations of ceramic armors, however, is that they dissipate the energy of the projectile partially by cracking. Therefore, ceramic armors lack repeat hit capability, i.e., they will not resist penetration if hit in the same position multiple times, and they disintegrate if struck by multiple rounds. Attempts have been made to address this problem, one of which is the use of metal-ceramic laminate or composite armors that have a metal layer or matrix, such as a Ti-6Al-4V layer surrounding a ceramic-based core. Nevertheless, while such materials can provide somewhat improved properties and performance, the ceramic portion eventually cracks in response to multiple projectile impacts, thereby greatly reducing or eliminating the effectiveness of the armor. Moreover, the costs of ceramic and metal-ceramic armors is generally significantly higher than those of other types of armor.

Another type of armor is typically known as reactive armor. Here, the armor includes an ablative or explosive material that reacts by ablation or even explosion when impacted by a ballistic projectile, typically so as to alter the flight of the projectile and its impact zone, thereby providing protection to the item with which it is associated. In explosive reactive armors, the outward force of the reactive armor explosion counteracts the force of the incoming projectile, thereby resisting penetration of the armor. Reactive armor designs may also include movable members that may, for example, absorb the energy of the projectile, blunt the projectile, modify the trajectory of the projectile, and/or destroy the projectile. Reactive armors, however, like ceramic armors, are somewhat deficient in that they do not provide good protection against multiple impacts in the same location. Once the reactive armor is activated, a second round hitting the armor in the same location is much more likely to penetrate the armor or otherwise damage the item being protected.

Various polymers and polymer composites have also been proposed for use as ballistic armor, such as the composite material described in U.S. Pat. No. 7,037,865, which employs the use of a matrix material such as a resin which is filled with various densely packed small particles, such as hollow microspheres, and may also include fibers, as a partial substitute for the particles or the matrix, or a flanking material for the matrix/particle composite.

Numerous types of fabrics, including woven and non-woven fabrics, as well as those which are layered in various combinations, or impregnated with various resins and other materials, or both, have also been employed as ballistic armor for personal protection applications, or body armor, including various forms of garments and head protection articles. These armors are made from polymer fibers, such as various aramid, ultra-high molecular weight polyethylene, polybenzoxazole and other fibers. Such "soft armor" garments and other articles have also been designed to incorporate spaces for the insertion of traditional "hard armor" plate inserts to enhance their resistance to and protection from ballistic projectiles. Since soft armor is frequently used for personal protection, the weight of the armor is very important, and it is desirable to maximize the ballistic resistance and protection while minimizing the weight. Since hard armor inserts can constitute a significant portion of the weight of such soft armor, it is very desirable to identify hard armor suitable for use as inserts that have reduced density and consequently weight as compared to traditional types of armor and which offer equivalent or improved ballistic resistance and protection performance. Body armor is categorized based on its ability to resist penetration by various small caliber projectiles into four subcategories (I-IV) by the National Institute of Justice under NIJ Standard 0101.4. Various US military specifications have also been developed for "soft" body armor and "hard" body armor inserts and define the operational and performance requirements for these materials Despite the many existing forms of armor described above, there remains need for new lightweight armor materials for various armor applications, particularly those which have multi-shot capability (resistance to multiple impacts) and reduced density and consequently weight as compared to existing types of armor and which offer equivalent or improved ballistic projectile resistance and protection performance.

SUMMARY OF THE INVENTION

In one aspect, the present invention includes an article of armor, comprising a friction material operative to prevent penetration of a ballistic projectile. The friction material offers repeat hit capability and is operative to prevent penetration of a plurality of ballistic projectiles at a single point of impact on the surface of the armor.

In another aspect, the armor of the invention may also include one of a backing or facing, or both. The backing may be formed from a friction material, such that the friction material constitutes a multi-layer stack or laminate, or may be formed from a non-friction material such as a metal.

In yet another aspect of the invention, the armor of the invention may be attached to the backing by means for attachment. The means for attachment may include an attachment mechanism, such as various types of fasteners, or an attachment material, such as various resin materials, glues, adhesives and similar materials.

In yet another aspect of the invention, the friction material includes a composite of a resin binder agent, a fibrous support structure, a friction modifier system and a wear system of filler materials.

In yet another aspect of the invention, the resin binder agent comprises a highly cross-linked polymer. The highly cross-linked polymer may include a thermoset polymer, a thermoplastic polymer, or co-polymers or other chemical or physical combinations thereof.

In yet another aspect of the invention, the resin binder agent includes at least one resin selected from the group consisting of phenolic, epoxy, condensed poly-nuclear aromatic, cyanate ester, melamine, melamine-formaldehyde, urea-formaldehyde, resorcinol-formaldehyde, polyurethane, polyalkyd, silicone, polyester, acrylic, furan and polyimide resins.

In yet another aspect of the invention, the fibrous structure comprises at least one fiber selected from the group consisting of metal, glass, mineral, carbon, polymer and ceramic fibers.

In yet another aspect of the invention, the friction modifier system comprises at least one friction modifier selected from the group consisting of graphites, metal sulfides, cashew shells, rubbers, metals, metal oxides, metal carbides and metal silicates.

In yet another aspect of the invention, the wear system comprises at least one filler selected from the group consisting of barium sulfate, calcium carbonate, magnesium silicate, magnesium carbonate, mica, alkali metal titanates, vermiculite, molybdenum trioxide, cashew dust, rubber dust and clay.

In yet another aspect of the invention, armor of the invention is made by a method including the steps of mixing to form a pre-polymer mixture, forming the pre-polymer mixture to form an article of armor, and polymerizing the pre-polymer mixture to polymerize the article of armor.

In yet another aspect of the invention, the method may include a further step of introducing a backing or an article to be armored prior to the step of forming the pre-polymer mixture to form an article of armor, so that the armor is formed onto the article to be armored.

In yet another aspect of the invention, the method may include a further step of attaching the polymerized article of armor to an article to be armored to form an armored article. Attachment may be performed using an attachment device, such as a mechanical fastener, or an attachment material, such as a thermoset resin, glue, adhesive or similar material.

In yet another aspect of the invention, the method may include a further step of forming an armor preform prior to the step of forming the pre-polymer mixture to form an article of armor and after the step of mixing to form the pre-polymer mixture.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

Figure 1:
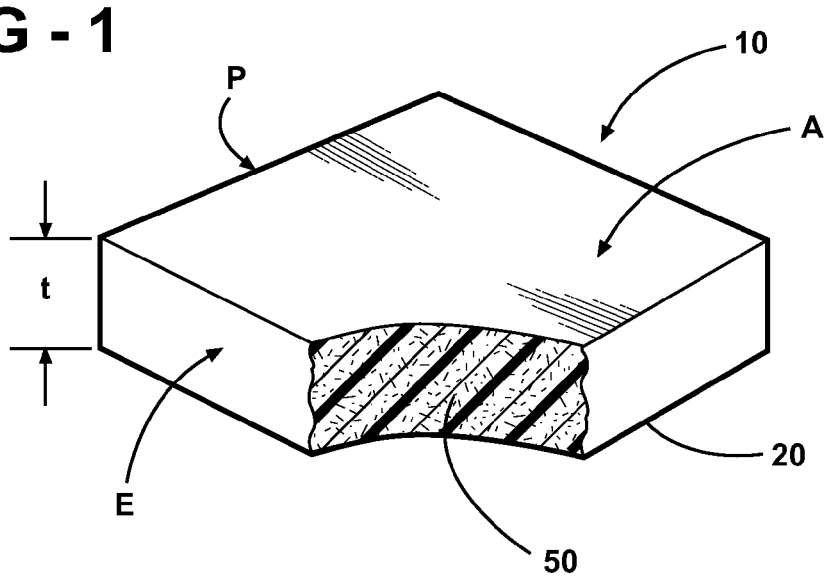
FIG. 1 is a partial cross-section view of an article of armor of the invention.

Referring to FIG. 1, the present invention comprises a relatively lightweight article 10 of armor 20 which provides resistance to penetration and thus protection from impact-related and other damage associated with the impact of various forms of ballistic projectiles 30, represented and illustrated symbolically using an arrow, which may be fired from a firearm, gun, launcher or otherwise projected at a surface 40 of article 10. Armor 20 comprises a friction material 50, including various friction materials of a type frequently used for various braking, clutching and similar applications, such as brake linings and clutch linings, respectively, which require strong, lightweight, high temperature, environmentally stable and durable materials that are typically adapted to provide, among other characteristics, controlled sliding friction and wear characteristics.

While the friction material used in braking and clutching applications may be used for armor 20, they are distinguished from these materials in several important respects. Firstly, armor 20 will generally have a thickness (t) which is thicker than the friction materials used in braking and clutching applications, except for certain heavy-duty trucks, locomotive and other large vehicle applications. Secondly, armor 20 will typically be utilized in configurations having a surface area (A) which is exposed to projectile impact which is greater than the surface area of a typical brake pad, drum liner or clutch friction pad, except perhaps those used in large vehicles, such as those described above. Thirdly, the shape configuration such as the shape factor associated with the periphery (P) of armor 20 will generally be different than those associated with the braking and clutching applications. For example, whereas braking and clutching applications typically utilize a cylindrical, semi-cylindrical or arcuate configuration, armor 20 will generally employ configurations with linear edges which can easily be aligned with adjacent mating linear edges, where curved edges are used, adjacent portions of armor 20 will be adapted to have a mating curve surface which is adapted to mate with an adjoining portion of armor 20 so as to form a joint between them where these pieces are in touching contact or closely proximate one another so as to provide resistance to penetration along the length of the joint. Fourthly, whereas the edge of a disc brake pad, drum brake liner or clutch plate is typically orthogonal to the friction surface, the edge (E) of armor 20 will generally be adapted for engagement with other portions of armor 20 (so as to enable armor coverage of large areas), such as by the incorporation of various tapers, lap-joints, tongue and groove, grooves which are adapted to receive an intermediary member (i.e. biscuit-type joint) or other configurations which enable overlap with adjoining portions of armor 20 along a joint so as to provide continuous armor protection along the joint. Fifthly, the friction surface of a disc brake pad, drum brake liner or clutch plate is a flat, planar surface, whereas the exposed surface of armor 20 (i.e., the surface exposed to potential impact from a projectile) may have any suitable shape, including both flat, planar surfaces as well as surfaces that are adapted to conform to the surface of the article to be protected, such as all manner of curved surfaces, step surfaces, corrugated surfaces and the like, having regular or irregular relief patterns or other features such that the surface of armor 20 is not a flat, planar surface. Sixthly, armor 20 may incorporate blind holes or other features incorporated into the surface which faces the article to be protected and away from the surface which is exposed to impact from a projectile, which are adapted to receive a fastener such as a screw, threaded bolt, cam-type fastener or the like for attaching the armor 20 and article to be protected which does not pass through armor 20 to the exposed surface. Seventhly, article 10 of armor 20 made from friction material 50 is also distinguished from braking and clutching components which also use friction materials by the fact that it is operative to resist or prevent penetration from a ballistic projectile 30 or a plurality of the same or similar ballistic projectiles, or more likely from a family of ballistic projectiles of varying shapes, sizes, weights and materials, which will generally have a random or variable angle of impingement on the surface of the friction material, rather than being operative for single use or repetitive engagement and disengagement with a predetermined friction countersurface of known size, shape, weight, and surface finish as is characteristic of various braking, clutching or other friction control articles. Finally, the friction countersurfaces in braking, clutching or similar friction control article and application do not constitute projectiles 30 of the invention as they are not designed to penetrate through the thickness of the friction material but rather are designed to frictionally engage the surface of the friction material, and even if they were designed to penetrate the surface, would not approach the countersurface as a ballistic projectile.

These aspects, either singly or in combination, serve to distinguish armor 20 from other applications of friction material 50, including disc brake pads, drum brake liners and clutch pads.

Figure 2:
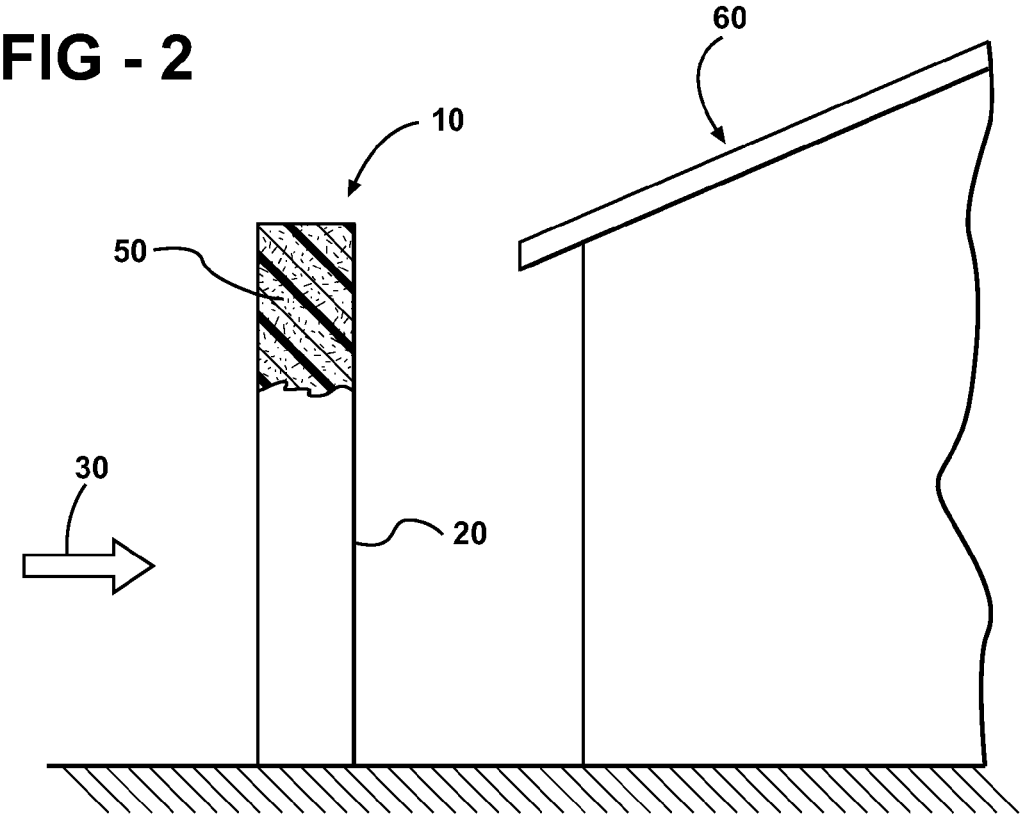
FIG. 2 is a partial cross-section schematic view of an article of armor and a protected article.

Referring to FIG. 2, armor 20 may comprise and be used on a stand-alone basis as a non-integral, free-standing or spaced protective barrier where it is placed at a distance from a protected article 60, but where the armor is not removably or permanently coupled or fixed to the protected article 60. One example, would include use of armor 20 as a fence, screen, enclosure or other barrier to protect a building, vehicle, person or other protected item from a ballistic projectile or other weapon. In this example, the armor 20 may have a fixed or variable position, but it is not attached or otherwise coupled to the protected article 60. In another example, (not shown) armor 20 could be used in the form of a shield, where the position or distance from the protected article 60 is not fixed, but generally variable, and where the armor is not removably or permanently fixed to the protected article 60, but perhaps is only temporarily grasped or held or placed into position when protection is desired.

Figure 3:
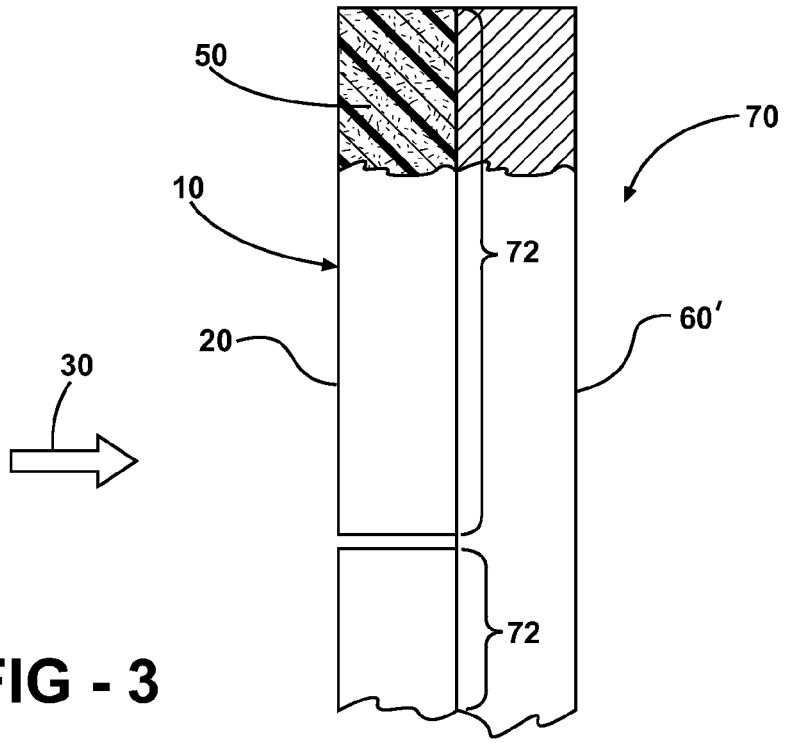
FIG. 3 is a partial cross-section view of an armored article.
Figure 4A:
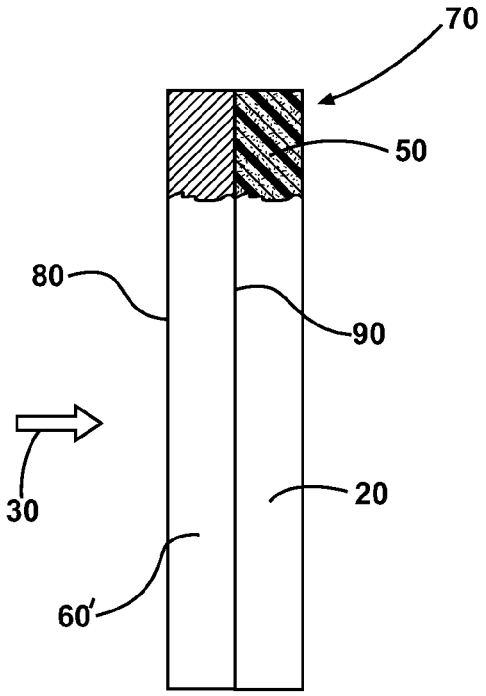
FIGS. 4 A-D are partial cross-section views of various illustrative arrangements and configurations of armored articles of the invention.
Figure 4B:
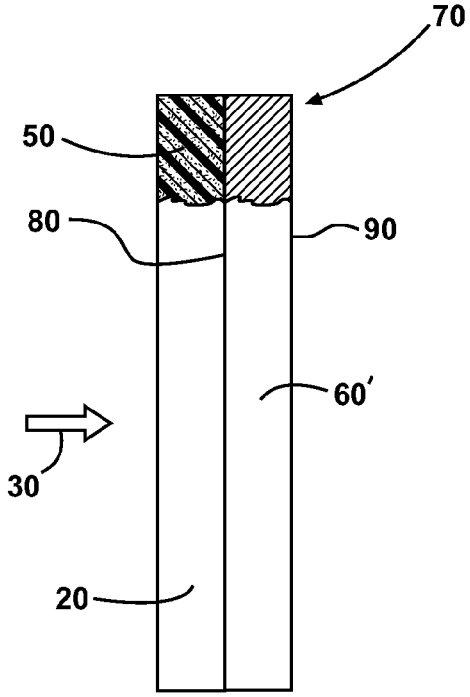
Figure 4C:
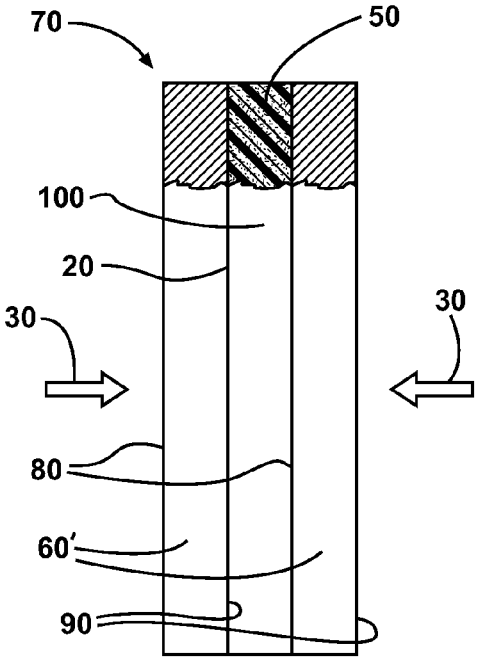
Figure 4D:
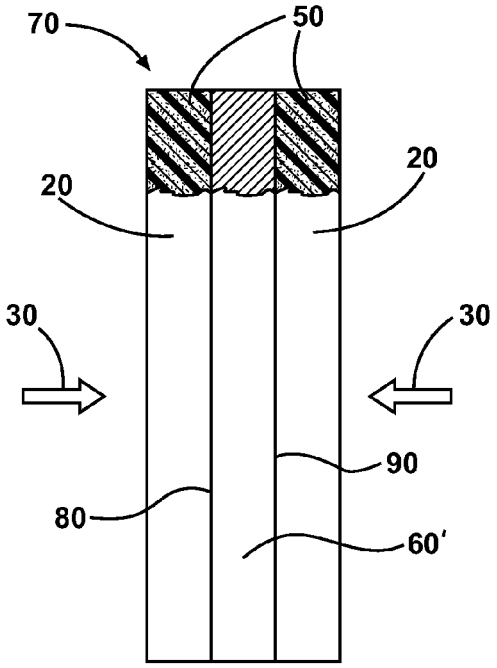

Referring to FIG. 3, armor 20 may be attached, fixed, coupled or otherwise connected to, either removably or permanently, an article 60' to be armored or protected thereby forming an armored article 70. Depending on the nature of the article 60' to be armored or protected, armor 20 may be placed on the side of the article 60' which is exposed to a threat from incoming projectile 30 or the opposite side 90 which is away from the threat from an incoming projectile 80, depending upon whether armor 20 is intended to be a first line or last line of defense with regard to projectile 30. This may comprise covering side 80 with armor 20 and using article to be armored 60' acting as a backing (FIG. 4A), or covering side 90 with armor 20 and using article to be armored 60' acting as a facing, (FIG. 4B) or insertion as one or more intermediate layers 100 with the article to be armored 60' acting as a facing and backing and which may offer protection from a projectile 30 coming from either direction (FIG. 4C) or where armor 20 is placed on both of side 80 and side 90 which may offer protection from a projectile 30 incident from either direction (FIG. 4D), or any combination of the above, in whole or in part. Armor 20 may completely cover or back or encase or infuse or otherwise be integrated throughout an armored article 70, or may cover or be attached to or infuse or otherwise be integrated throughout only a part or portion 72 of armored article 70 (as shown in FIG. 3), or alternately multiple portions 72 of armored article 70, in any combination. In short, any surface, including any external, internal and intermediate surface of article 70 may be armored, in whole or in part, and in any combination, by appropriate incorporation of armor 20.

Figure 9:
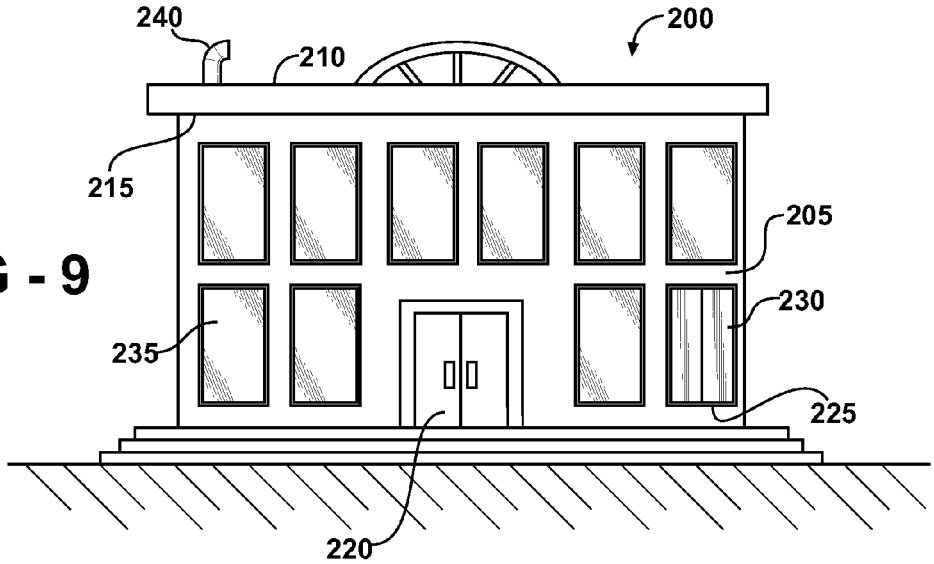
FIG. 9 is a schematic view of a building having various articles of armor associated therewith.

Article 10 may be any article 10 which is adapted for use as or otherwise operative as an element of armor 20 with respect to impact from a ballistic projectile 30. Ballistic projectile 30 may be any type of projectile or other armament or device, including projectiles of various calibers or sizes fired from a gun or launcher, as well as all manner of projectiles resulting directly or indirectly from detonation of a bomb, munition or other explosive device. Article 10 may include all manner of components, including components that are integral elements of a structure or mechanism and participate in their function, or elements that are non-structural or not elements of another mechanism and do not participate in their function, which have as their sole function service as armor 20 to provide protection from ballistic projectiles 30. For example, article 10 may include an armored structural panel, such as a wall or ceiling panel which both provides ballistic protection while at the same time serving a support or design function in a structure, or may function as a panel which solely provides ballistic protection and has no other structural or design purpose or function. As a non-limiting example, article 10 may include all manner, shapes and sizes of structural panels used in various types of structures 200 and components thereof, including panels for the walls 205, roofs 210, ceilings 215, doors 220, frames 225, shutters, 230, windows 235, ducts 240 and other portions of various types of buildings (see FIG. 9), as well as various components and other elements (not shown) of bridges, tunnels, fences, posts, signs, decorative members and the like. As a further non-limiting example, article 10 may also include armor 20 for all manner of articles used as armor for, or as an armored component of, a vehicle, vessel, craft or armament; including automobiles, trucks, buses, heavy equipment and other land-based vehicles or equipment; boats, ships, submarines, barges, hovercraft and other water-based vessels; airplanes, helicopters, gliders, remotely operated vehicles (ROV's), missiles, spacecraft and other air-based or space-based vessels or other types of craft; tanks, armored personnel carriers, self-propelled artillery, self-propelled rocket and missile launch vehicles, tanks, fixed or movable artillery, rocket launchers, gun mounts, gun platforms or other forms of military equipment or armament. Article 10 may also include armor 20 in the form of personal protective articles, or inserts or attachments for personal protective articles, including all manner of bullet-proof or bullet-resistant clothing or apparel, such as vests, shirts, coats, pants, shin guards, forearm guards, elbow guards, neck guards, footwear, such as socks, shoes, boots and the like, headgear, helmets, face shield and other clothing or apparel, as well as hand-held or remotely positioned barriers or barricades. These are merely exemplary of some of the applications of various articles 10 of armor 20 that are possible within the scope of the present invention.

Figure 5:
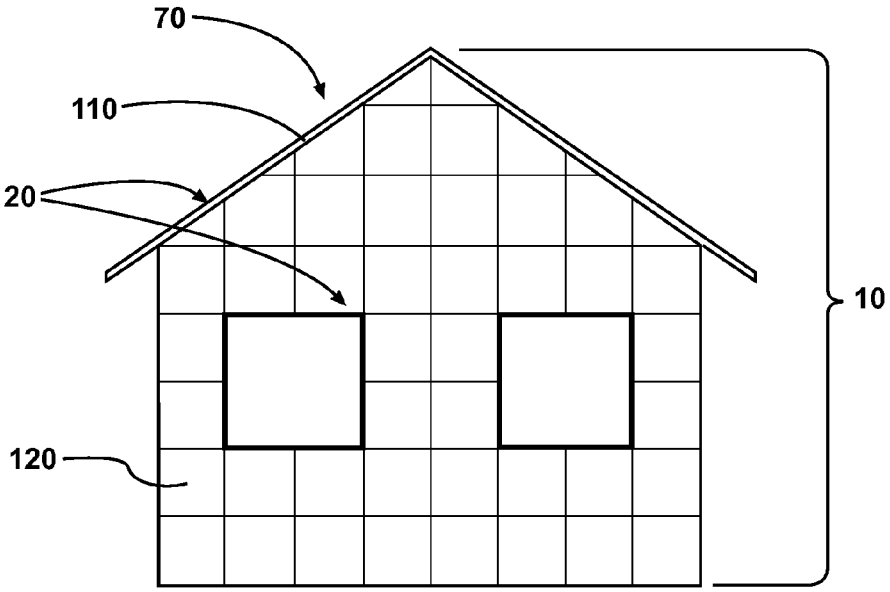
FIG. 5 is a schematic view of an armored article of the invention.

Article 10 of armor 20 will generally be applied to or incorporated as a portion of the items listed above to provide protection thereto, and frequently will not constitute the entirety of these items, but may do so depending on the particular application and requirements of the armor. As will be understood from the method of making described hereinbelow, armor 20 may be made into virtually any size and shape or adapted to virtually any required size or shape, either as a single piece, or by utilizing and integrating several pieces to form the necessary shape. Where multiple pieces are used, they may be applied individually to another article 60' to form armor 20 and armored article 70, or they may be joined to one another first to form armor 20 and then used either to protect an article 60 or with article 60' to form armored article 70, as described herein. Since armor 20 may be made by various molding methods, virtually any combination of flat, curved, irregular or other surface contour or thickness profile may be formed. Likewise, virtually any size and thickness is possible. This may be accomplished by appropriate scaling of the molds and molding equipment. Article 10 may take virtually any form depending on the required shape, size and application environment of the armor 20. This may include plates, sheets, covers, overlayments, underlayments, appliqués, laminates and the like. For example, for building applications, it is believed that article 10 may be formed into standard sizes of construction materials, such as 2'×4', 4'×8' and 4'×12' sheets or similar metric sized equivalents of various thicknesses, including standard English thicknesses used in the US such as 0.125, 0.375, 0.500, 0.675 and 0.750, 1.0 inches or similar metric equivalents, or in sheets having a complementary thickness to be joined to drywall, plywood, oriented strand board, steel or other metal sheets and similar construction materials so as to maintain as an overall thickness those noted above or other standard thicknesses (e.g. 0.375" armor laminated to 0.375" plywood to form a 0.75" laminate), or may be made into any desired custom thickness also. As another similar example, article 10 of armor 20 may be formed into the form of other standard construction materials, such as 1" and 2" thick "boards" of various widths and lengths, or cylindrical shapes including conduits or pipes of varying wall thicknesses, outer diameters, and lengths, or into the shapes of all manner of well-known enclosures, housings, panels and other articles used in buildings. As yet another example, article 10 of armor 20 may have the form of a tile, (e.g., floor, wall and ceiling tiles) brick, block or other basic construction element. In the case of bricks, blocks and tiles, any size, including standard English and metric sizes may also be utilized. In this way, these elements can be laid in a matrix or grid pattern to cover larger areas. Further, multiple layers of armor 20 may be employed to increase the overall thickness of article 10. An example is shown in FIG. 5, wherein an article 10 in the form of a building has applied to an exterior surface thereof an overlay of armor 20 in the form of sheets 110 applied to the roof and tiles 120 applied over the exterior walls in a grid pattern. As illustrated in FIGS. 6A-6D, when armor 20 is applied as tiles or sheets or the like or in a grid or similar pattern, such that a plurality of pieces are placed in abutting contact along their edges, it is believed to be preferred that the edges of the tiles, sheets or the like have an edge form such that adjacent pieces overlap one another so as to avoid having a straight line path, particularly those which are orthogonal to surface of armor 20, through the thickness with regard to potential impingement of ballistic projectiles 30. All manner of beveled, tapered mortise and tenon, tongue and groove, lap-joint and other configurations which avoid creation of such straight line paths through the thickness of the material at the joint may be utilized. However, the use of butt joints is also within the scope of this invention, or even a spaced-apart configurations.

The tiles or sheets or the like may be attached to a substrate using a means for attachment to the substrate 140, such as an adhesive to promote chemical or physical attachment to the substrate, or with other attachment devices as described herein, such as various types of fasteners. When armor 20 is molded directly onto an article to form armored article 10, the means of attachment 140 may also be the resin material used as the matrix of friction material 50, which can be directly bonded to many different types of materials comprising article 10 in conjunction with curing and polymerization of the resin matrix.

Similarly, a means for attachment 150 of adjoining portions of armor 20, such as an adhesive, mortar or other filler may also be inserted along the abutting edges to further strengthen and seal the joint between them and improve the overall strength of armor 20. When armor 20 is molded directly onto an article to form armored article 10, the means of attachment 150 may also be the resin material used as the matrix of friction material 50, which can be directly bonded to itself in conjunction with curing and polymerization of the resin matrix. Further, the abutting edges may incorporate adjoining grooves 22 which are operative to receive a joining member 24 which may have the form of a strip or other member operative to extend into the adjoining grooves 22 for the purpose of strengthening the joint and eliminating a straight-line path through the thickness of adjoining pieces of armor 20. In addition to joining member 24, grooves 22 may also be adapted so as to be able to receive means for attachment such as adhesive 150, and may be sized relative to joining member 24 so as to facilitate the presence of adhesive 150. Grooves may extend along the entire length of the abutting joint, or only a portion thereof. Similarly, joining member 24 may extend continuously along the length of the joint, or only a portion thereof. joining member 24 may be adapted to the form of a "biscuit" so as to enable the use of this form of joinery. Joining member 24 may be made from the same material as armor 20, or any other suitable materials, such as wood, plastic or steel. Preferably, joining member 24 would also afford resistance to penetration from projectile 30.

Figure 10A:
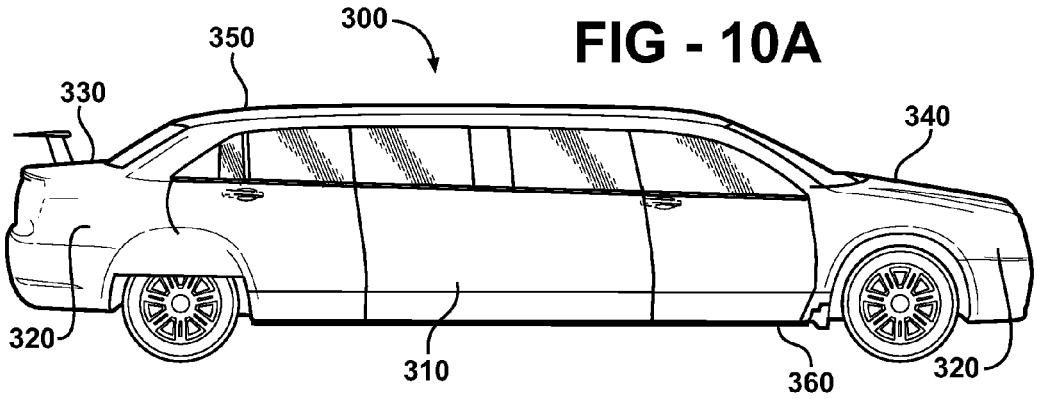
FIG. 10 is a schematic view of several types of vehicles having various articles of armor associated therewith.
Figure 10B:
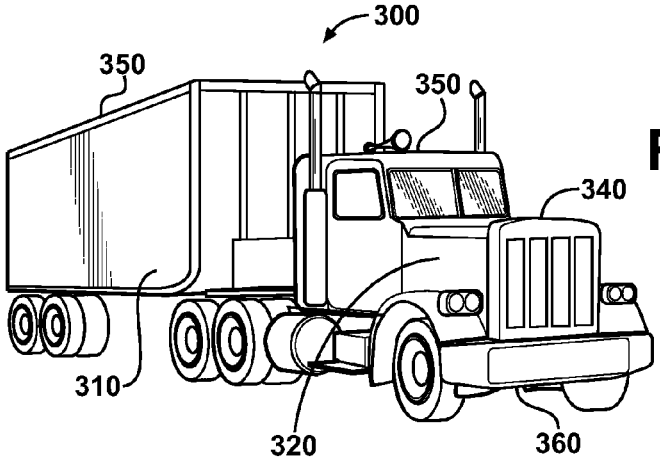
Figure 10C:
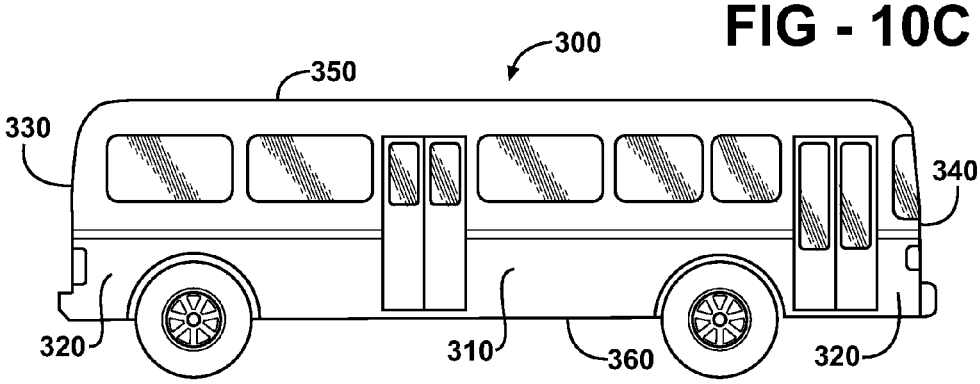

The examples above are directed to articles 10 of armor 20 for building and construction applications. Similarly, in applications related to various vehicles 300 as described above and illustrated in FIGS. 10 A-C), articles 10 of armor 20 may be formed into or so as to replace or so as to be used as or in conjunction with various body panels, including side 310, quarter 320, trunk 330, hood 340, roof 350 and bottom 360 panels, as well as frame members, housings, covers, trim, interior ceiling, side and door panels, trunk liners, firewalls and the like. Similarly, for vessels, armor 20 may be formed into or so as to replace or so as to be used as or in conjunction with hull structures, bulkheads, substructure members, superstructure members, turrets, barriers or shields, gun emplacements, housings, covers, hatches and the like. Still similarly, for aircraft and spacecraft, armor 20 may be formed into or so as to replace or so as to be used as or in conjunction with various bulkheads, fuselage panels, engine housings, gun housings, shrouds, interior panels, housings, covers, hatches and the like.

Figure 8A:
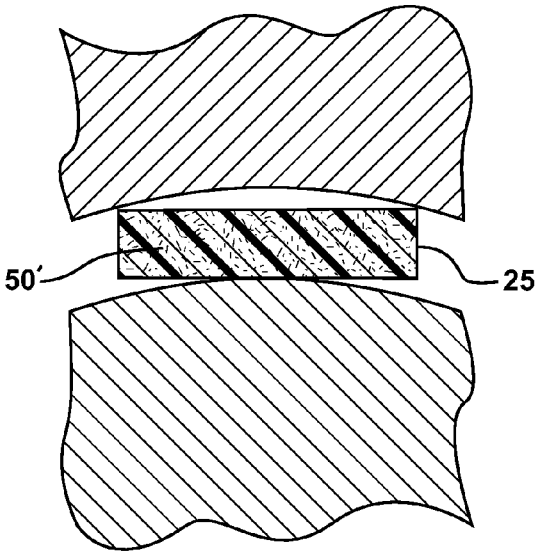
FIG. 8 is a schematic view of formed article of armor made by a method of forming an armor perform.
Figure 8B:
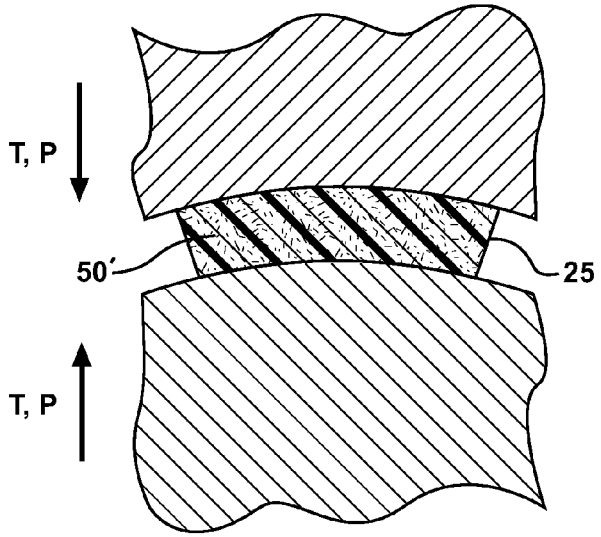
Figure 8C:
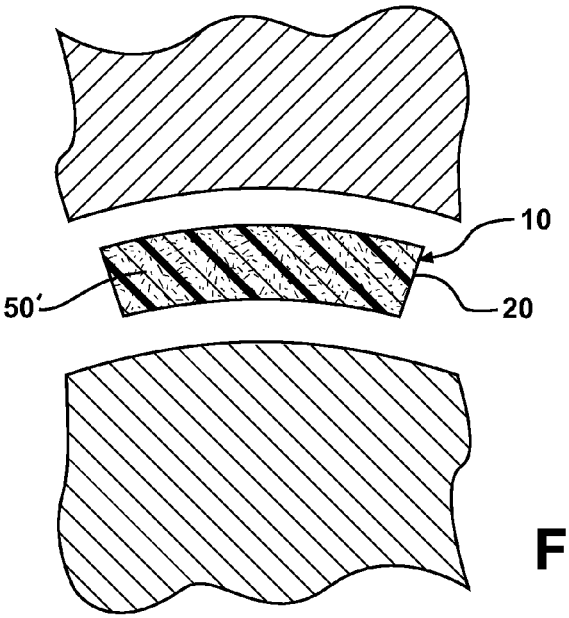

Referring to FIGS. 8A-C, it is believed that with the use of resin binding agents comprising thermoset resins, that armor 20 may be formulated from various compositions that permit partial curing, including all manner of precursor and prepreg materials, such as curing to a B-stage, of an armor preform 25 which may be molded, formed or otherwise shaped and cured at elevated temperatures and pressures to form an article 10 of armor 20. Such armor preforms 25 also comprise this invention. It is believed that armor preform 25 may have any suitable shape, but that it may be desirable to provide armor preform 25 in one or more basic precursor shapes, such as flat sheets or plates, right circular cylinders, disks and the like, any of which may be formed into a any number of final shapes and forms, such as those described herein. This has the potential advantage of using a limited number or inventory of starting blanks to form a larger number of final shapes or products.

Friction material 50 includes those materials commonly used as disc brake pad and drum brake liner friction materials, but is also believed to include materials having similar constituents and compositions that are commonly used as clutch friction materials, and are also believed to include all manner of material compositions that incorporate these constituents, even though not commonly used as brake or clutch friction materials or having frictional properties not well-suited for commercial use in these applications. Friction materials generally have the following characteristics, namely, a high static and dynamic coefficient of sliding friction under various environments, a stable and predictable dynamic coefficient of friction over a wide range of operating temperatures −40 to 1200° C. and controlled (generally to a minimum) wear characteristics, including countersurface (opposing surface) wear, shear strength sufficient to resist rupture, corrosion resistance to water, salt, sand, gravel and mud. Friction materials are also generally thermally insulating, possess dampening characteristics and are lightweight.

Armor 20 comprises friction material 50, and may also be described as comprising a matrix of a resin binding agent 52, a fibrous support structure 54, a friction modifying system 56 and a wear system 58 of fillers. Friction material 50 is a composite of these constituents, wherein the resin binding agent 52 forms a polymer matrix to bind together the fibrous support structure 54, friction modifying system 56 and wear system 58. The constituents generally may be categorized as a chemical mixture and a composite material, but also will be understood to include compositions where one or more of the constituents have partial or complete solubility in one or more of the other constituents.

Resin binding agent 52 is believed to include any suitable resin which polymerizes to form a matrix capable of binding together the other constituents of friction material 50. It is preferred that resin binding agent 52 comprise a thermoset polymer resin in an amount of about 5 to about 30 percent by weight of friction material 50. Thermoset polymer resins characteristically have a highly cross-linked polymer structure It is believed that other polymers with highly cross-linked structures may also be suitable for use as resin binding agent 52, including various co-polymers of thermoset and thermoplastic materials, as well as thermoplastic materials that exhibit a high degree of cross-linking and have mechanical and physical properties similar to those noted herein for thermoset materials. It is preferred that resin binding agent 52 comprise a phenolic resin, such as a phenol-formaldehyde resin. However, it is believed that many other resins are well-suited for use as resin binding agent 52, such as various epoxy-modified phenolic, silicone-modified phenolic, condensed poly-nuclear aromatic, cyanate ester, melamine, melamine-formaldehyde, urea-formaldehyde, resorcinol-formaldehyde, polyurethane, polyalkyd, silicone, polyester, acrylic, furan and polyimide resins. It is believed that heat resistant resins are particularly advantageous as resin binding agent 52, as they provide the synergistic benefit of heat resistance to armor 20 which may be desirable to provide protection against certain ballistic projectiles which have incendiary characteristics. As an example, many of the thermoset resin binding agents 52 used in friction material 50 used for brake linings have elevated ignition temperatures, on the order of 1100° F., and will generally will self-extinguish in air unless subjected to an open flame or other continuous heat source.

Fibrous support structure 54 may include any suitable fibrous support structure 54. Fibrous support structure may include continuous, discontinuous, chopped and other fibrous support structure, or a combination of the above, and may include various woven and non-woven fiber elements, such as various fabrics, felts, mats, honeycomb-like fabric and fiber structures and the like. Important characteristics of fibrous structure are fiber orientation, aspect ratio, fiber-binder adhesion, fiber strength and fiber morphology. Generally, it is believed to be preferred that fibrous support structure 54 will include a plurality of discontinuous fibers with a random fiber orientation in the resin mixture resulting from the step of mixing as described herein. Any suitable fiber material or combination of fiber materials may be used, including, without limitation, those of various grades of steel (e.g., high carbon, low carbon and stainless steels) and other metals, glasses, ceramics, minerals, cotton, carbon or other fibers, both natural and man-made or synthetic fibers. Besides various steel fibers, metal fibers may include iron and iron alloys, copper and copper alloys and any other metals capable of providing a support structure. Glass fibers may include all manner of silicate and non-silicate glass fibers, including both boron-containing and boron-free E-glass, as well as all manner of other commercial grades of glass fibers. Ceramic fibers may include various metal oxides, carbides, nitrides, silicates and titanates, such as aluminum oxide, silicon carbide, silicon nitride and potassium titanate. Carbon fibers may include those made of carbon and various carbon compounds, including various carbon polymers, such as various aramid, ultra high density polyethylene, polybenzoxazole, polyacrilonitrile (PAN), cellulose and other carbon-containing polymeric fibers. Mineral fibers may include basalt, sepiolite, mineral wool, asbestos and other mineral fibers. The fibers of fibrous support structure 54 generally have a diameter of about 1 mm or less, depending on the fibrous material used, but larger diameter fibers may be used. Discontinuous fibers generally have a length of about 0.5 inches or less, again depending on the fibrous material used, and are generally no less than three times longer than they are wide. Glass fibers generally have a diameter of about 10-100 microns and a length of 0.125-0.5 inches. Aramid fibers generally have a diameter of about 10-30 microns and a length of about 1 mm or less, but may be considerably longer depending on the application. Mineral fibers generally have a diameter of 3-50 microns, and are generally no less than three times longer than they are wide. Generally, fibrous support structure 54 comprises 10-50 percent by weight of friction material 50, depending on the fiber type used and other factors.

Friction modifying system 56 may comprise a single friction modifying constituent or a plurality of friction modifying constituents. Friction modifying system 56 is used to adjust the friction level of the friction material comprising armor 20 as needed. More particularly, friction modifying system 56 is used to adjust the friction coefficient of friction material 50. Friction modifying system 56 may include any friction modifying constituent or combination of constituents. Generally, these constituents fall into two categories, lubricant and abrasive materials. Commonly used lubricant materials as friction modifying constituents include various forms of graphite, such as graphite powder and flakes, and various metal sulfides, such as those of tin, copper, lead, molybdenum and antimony, as well as cashew shell friction particles and rubber crumb or particles, either individually or in combination. Commonly used abrasive materials as friction modifying constituents include metal powders, such as copper, copper-zinc, copper-tin, iron, and aluminum powders. They also include metal oxide, carbide and silicate particles, such as aluminum oxide, magnesium oxide, iron oxide, zirconium oxide, chromium oxide, silicon oxide, zirconium silicate and aluminosilicate particles, individually or in combination. Friction modifying system 56 may include many other mineral, organic and ceramic materials including both natural or man-made materials which may act as friction modifying constituents. Friction modifying system 56 preferably comprises 0.5 to 40 percent by weight of friction material 50. Friction modifying constituents generally have a maximum particle size (or diameter for spherical particles) ranging from about 5 microns to 8 mesh (about 2.36 mm), but it is believed that particles having larger and smaller sizes may be also used. As examples, aluminum oxide particles typically have a size of about 5 microns, cashew friction particles have a size of about 20 mesh (about 0.85 mm), carbon particles have a size of about 8-325 mesh (0.045-2.36 mm) and silica particles have a size of about 200-325 mesh (0.045-0.075 mm).

In friction material 50 as a friction constituent, wear system 58 as a filler may have many functions, including filling the resin matrix to provide improved high temperature and wear properties of friction materials 50, as well as to provide colorants and other materials which control various other physical or chemical properties or both of friction material 50. Wear system 58 comprises filler materials used to further modify and control, together with other friction constituents, various other chemical and physical properties and characteristics of friction material 50 and thus armor 20. These may include heat resistance, wear control, density, color and various other physical and chemical properties. Wear system 58 fillers will depend on, among other factors, the resin binding agent 52, fibrous support structure 54 and friction modifying system 56 selected. These fillers may include organic as well as inorganic filler constituents, including various metal silicates. Examples include, in its man-made or mineralogical forms, barium sulfate (e.g., barytes), calcium carbonate (e.g., calcite, chalk), magnesium silicate (e.g., talc), magnesium carbonate (e.g., dolomite or magnesite), mica, alkali metal titanates, vermiculite, molybdenum trioxide, cashew dust, rubber dust, kaolin and various clays. It will be noted that cashew particles and rubber particles may also be used as part of friction modifying system. These materials are used individually or in combination with other similar materials at typically 10 to 40 percent by weight of friction material 50. Wear system 58 constituents generally have a maximum particle size (or diameter for generally spherical particles) less than or equal to about 100 mesh (about 0.149 mm), but it is believed that particles having larger sizes may also be used.

The foregoing describes generally the constituents of friction material 50 including a number of examples of specific materials which may be used with these constituents as well as quantitative ranges for these constituents. However, most, if not all, friction materials 50 are believed to be useful for making an article 10 of armor 20, including the compositions of friction materials set forth in the following U.S. Pat. Nos. 3,856,120; 3,998,573; 4,119,591; 4,145,223; 4,178,278; 4,182,437; 4,193,956; 4,218,361; 4,219,452; 4,226,758; 4,313,869; 4,352,750; 4,388,423; 4,432,922; 4,461,643; 4,476,256; 4,487,729; 4,537,823; 4,605,595; 4,617,165; 4,656,203; 4,772,950; 4,775,705; 4,792,361; 4,994,506; 5,083,650; 5,132,065; 5,145,888; 5,190,991; 5,279,777; 5,325,941; 5,339,931; 5,344,854; 5,383,963; 5,515,950; 5,516,816; 5,520,866; 5,535,860; 5,576,358; 5,676,577; 5,817,411; 5,861,203; 5,889,080; 5,889,082; 5,891,933; 5,919,837; 5,971,113; 6,013,146; 6,022,502; 6,051,646; 6,080,230; 6,107,386; 6,110,991; 6,140,388; 6,167,992; 6,190,761; 6,220,405; 6,228,815; 6,260,674; 6,265,356; 6,284,815; 6,298,957; 6,316,083; 6,474,453; 6,475,614; 6,502,674; 6,579,920; 6,612,415; 6,630,416; 6,632,857; 6,670,408; 6,863,968 which are hereby incorporated herein by reference in their entirety.

Friction material 50 physical properties will be a function of the method used to make the material. Properties generally used to characterize friction materials 50 include the specific gravity or density (SAE J380), transverse rupture strength (ASTM D790, modulus of elasticity, tensile strength (ASTM D638), Gogan hardness (ASTM J379), friction coefficient (SAE J661) and wear characteristic (SAE J661). The density of friction material 50 is generally in the range of about 1.85-2.5 g/cm$^3$ and typically is about 90% or more of theoretical density of the frictions constituents. The transverse rupture strength of friction materials is generally in the range of about 2500-12,000 psi. The tensile strength as measured is generally in the range of about 300-1000 psi and the elastic modulus is in a range of about 0.8 to $1.4\times10^6$ psi. The Gogan C-scale hardness is generally in the range of about 5-50 Gogan C. The friction coefficient is generally about 0.20-0.70, and a typical wear measurement of the material following the friction test is in the range of about 5-20%.

Armor 20 is known to effectively resist penetration and provide protection from impact-related damage associated with many small caliber (i.e., generally 14.5 mm diameter or smaller) ballistic projectiles as described in more detail hereinbelow. However, appropriately configured, particularly with regard to increasing its thickness, armor 20 is also believed to have effectiveness against any number of other armaments, including, without limitation, many other types of ballistic projectiles, such as larger caliber projectiles, including those which incorporate high explosives, incendiary materials, fragmentation devices and the like, and those designed to have enhanced armor-piercing characteristics (i.e., various sabot projectiles, heavy metal penetrator projectiles and the like). Armor 20 is also believed to have effectiveness with regard to all manner of munitions, explosive devices and other armaments, including, those developed or improvised by civilian, military, paramilitary, terrorist and other organizations.

Figure 11:
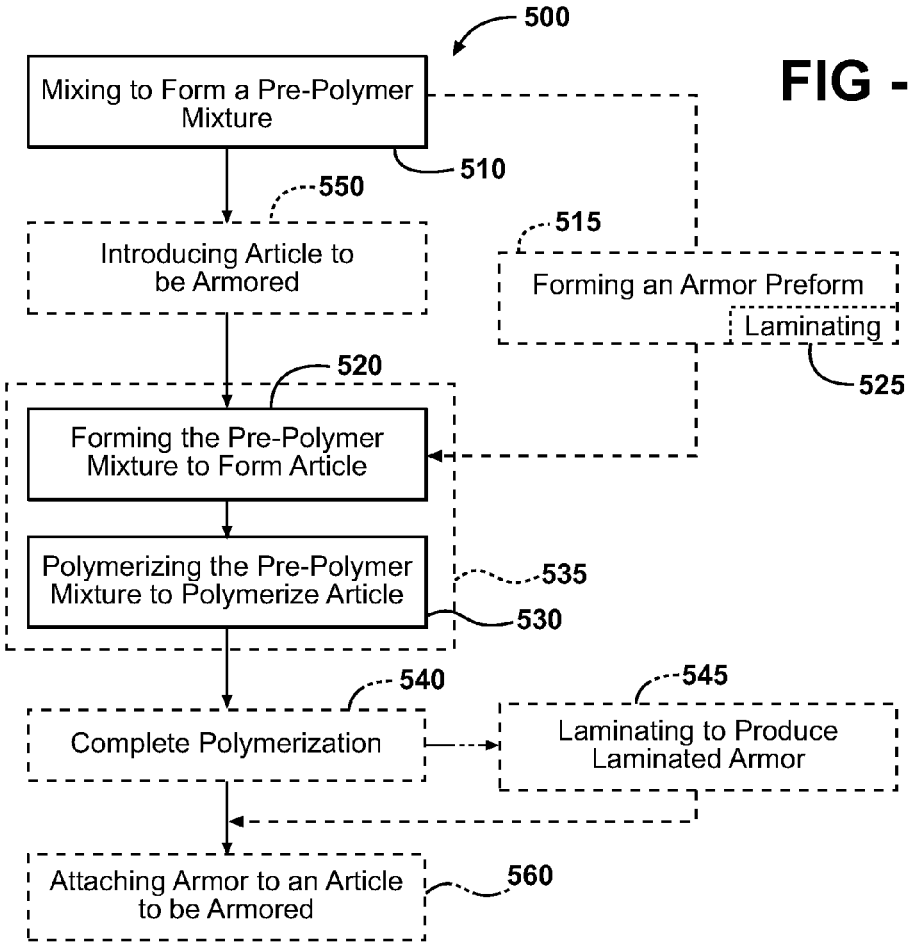
FIG. 11 is a flow chart illustrating a method of making armor and an armored article.

Any suitable method may be utilized to make armor 20 and form armored article 10, such as by attaching armor 20 to an article. Referring to FIG. 11, armor 20 may be made by a method of mixing the initial constituents to a substantially homogeneous pre-polymer mixture and then converting the pre-polymer mixture to a hard dense finished product by, for example, completing the polymerization reaction, such as by polymerization of a thermoset resin using heat and pressure, as described below.

The friction material constituents 502 may be mixed to form pre-polymer mixture 504 using any suitable mixing process, depending largely on the specific friction material and the specific constituents. The friction material constituents may be pre-mixed in any desired combination. They may be added together in any combination prior to the start of mixing and then mixed, or may be added to a mixer sequentially in any combination, depending on the requirements of the specific friction material composition and the constituents being used. Mixing 510 may be performed using any suitable mixing device, depending on the constituents and requirements associated with the process reactions, homogeneity requirements and other factors.

Exemplary mixers may include those which use a shaft, screw, blades, ribbons, impellers or propellers or combinations of the above to mix industrial materials. Industrial mixers force the mixture to flow in one direction and can intensify physical and chemical processes. Mixing may be performed in batch or continuous-feed modes. Batch mixing is the simplest mode of operation. The industrial mixer is filled with the friction constituents and product mixing is allowed to proceed. When mixing is complete, the mixing vessel's contents are emptied for downstream processing. The industrial mixer is then cleaned and refilled for mixing another batch. With continuous-feed industrial mixers, the media to mix is added continuously as mixed fluid is removed. Continuous mixers are particularly suitable for high volume production applications because they can run continuously for long periods of time without being shut down. However, any suitable type of industrial mixer may be used including conical, fluidized bed, impeller, paddle, planetary, propeller, ribbon, screw, static, turbine, vertical turbine, ultrasonic, and vibrational mixers. Screw mixers use a rotating screw that moves around the periphery of a conical hopper. Fluidized-bed homogenizers are durable vessels which fluidize the complete product bed. Impeller mixers and propeller mixers use vertical blades attached to a horizontal disc. Paddle mixers have a horizontal rotating shaft with fixed arms and paddle-shaped feet. Planetary mixers have two mixing blades that rotate around individual shafts. Ribbon mixers have a ribbon-shaped, counter-transport mechanism. Static or motionless mixers consist of fins, obstructions, or channels that are mounted in pipes. Turbine mixers include a wide range of general-purpose mixing equipment, operating at reduced speeds via an enclosed gear drive, with one or more multi-bladed impellers mounted on an overhung shaft. The mixers may use agitators, homogenizers, kneaders, mullers, tumblers and drums. They may comprise machines using a rotor-stator, a single rotor, or a twin rotor. Homogenizers are mechanical devices that create a stable, uniform dispersion of an insoluble phase within a liquid phase. There are many different types of tumblers and drums. Examples include double-cone tumblers, twin-shell tumblers, and horizontal drums. A rotor-stator is a single-shaft industrial mixer with an impeller rotating in close proximity to a stationary housing. They are particularly effective at chopping coarse particles such as rubber or flake resin. Single rotor and twin rotor devices consist of one or two shafts, respectively, with paddles or screws. Suitable shaft speeds for these industrial mixers ranging from moderately low to relatively high speeds.

Once the friction material constituents have been mixed, the pre-polymer mixture is formed using any suitable process for forming 520 and polymerized using any suitable process for polymerizing 530 the friction material constituents 502 to produce article of armor 20 having the requisite friction material characteristics, such as those described herein. However, requisite friction material characteristics may also include any combination of other chemical, physical and mechanical characteristics. Chemical characteristics may include the degree and nature of the polymerization reaction, chemical resistance characteristics and the like. Physical characteristics may include morphological characteristics such as homogeneity, location or segregation of the constituents within the polymerized matrix and the like. Mechanical characteristics may include the mechanical strength, impact resistance, including ballistic impact resistance, or other standard mechanical characteristics that may be measured using well-known and standardized mechanical testing methodologies. Forming 520 and polymerizing 530 may be performed separately or alternately may be performed simultaneously as a forming/polymerizing step 535.

One exemplary method for forming 520 the pre-polymer mixture 504 to form article 10 of armor 20 and friction material 50 employs extrusion, calendar rolling or a combination thereof. The pre-polymer mixture 502 using a liquid resin is placed under pressure in a nozzle with an appropriate shape, or alternately, by passing the material between two opposing rotating calendar rolls, and forced under pressure to conform to the shape of the nozzle or the calendar rolls as the pressure extrudes or calendars, respectively, the material through the particular device. Polymerizing 530 may be accomplished by applying heat during the extrusion/calendaring (535) or separately afterward (530) or both.

Another exemplary method 500 for forming 530 the friction material 50 and polymerizing the pre-polymer mixture employs cold forming. In these materials, the pre-polymer mixture 502 uses a solid resin binder. The pre-polymer mixture 502 is stamped or otherwise pressed under high pressure to a specific shape and then cured with low or no pressure at temperatures sufficient, to complete the chemical polymerization reaction and cure the resin. Typically, the temperature used for curing may exceed those needed to ensure polymerization of pre-polymer mixture 502. This method is similar in some respects to methods used for powder metal processing to press and sinter some metal articles.

Yet another example of the steps of forming 520 and polymerizing 530 the pre-polymer friction material 502 mixture employs hot forming. In these materials, the pre-polymer friction material mixture may use either a solid resin binder or a liquid resin binder, or a combination of both. The pre-polymer friction material mixture is placed in a heated mold and press cured under moderate pressure until the "cure" or the chemical polymerization reaction reaches the desired degree of completion, either full or partial polymerization. If the material is only partially cured, it is cured sufficiently to retain the form of article 10, and then the material may then be processed at an elevated temperature, either with or without applied pressure, in a step to further complete the polymerization 540.

Yet another example of the steps of forming 520 and polymerizing 530 pre-polymer friction material mixture 502 employs forming an armor preform 25 of a pre-polymer friction material, such as by forming 515 a pre-polymer friction material as described herein and partial curing it to a B-stage or partially cured armor preform 25, followed by the steps of forming 520 and polymerizing 530 as described herein to form an article 10 of armor 20.

Prior to or in conjunction with the step of forming 520 the friction material, it may be desirable to employ a step of introducing 550 an article to be armored 60' having a surface that is adapted and operative to receive pre-polymer friction material mixture 502. The surface may be adapted and made operative to receive pre-polymer friction material mixture 502 by employing various cleaning steps to remove contaminates from the surface of article to be armored 60', or by the application of various primers or other adhesion promoting materials to the surface. This article to be armored 60' is introduced so that the pre-polymer friction material 502 may be formed or polymerized directly onto the surface of the article to be armored 60'. This may include the partial or entire covering of the surface of the article 60'. For example, referring to FIG. 3, the friction material 50 as an armor 20 may encase the article to be armored 60'. Alternately, the friction material as an armor may cover only a portion 72 of the surface of the article to be armored 60', such as in the case of adding the friction material as a backing or facing layer to an article 60' comprising a panel, including all manner of flat, curved or formed panels.

In all of the embodiments of the step of forming 520 the friction material 50, forming 520 may also comprise shaping the friction material 50 into an intermediate or final shape or configuration. Configuration includes the addition of various features to a given shape such as the incorporation of various types of openings, holes, tabs, slots, protrusions, steps and the like, or combinations thereof, that may be used to alter the performance characteristics of the armor 20, or to assist, enable or otherwise facilitate the attachment of the armor 20 to an article to be armored 60' or to other elements of armor 20 (e.g., using various types of mechanical fasteners, mechanical interlocking elements, adhesives, combinations of the above, or otherwise). Forming to an intermediate configuration or shape may include forming to a near-net shape or configuration or it may also include the use of additional processing, such as sawing, machining, drilling, reaming, grinding and the like to form a final shape, configuration or both. Forming 520 may also include forming to a net or final shape, configuration or both.

As described above, where the friction material is formed to an intermediate shape or configuration, the method may further include a step or plurality of steps of mechanically processing the formed friction material to a final shape or configuration. As noted, this may include additional processing, such as sawing, machining, drilling, reaming, grinding and other forms of mechanical processing to form a final shape or configuration, or both.

Figure 7:
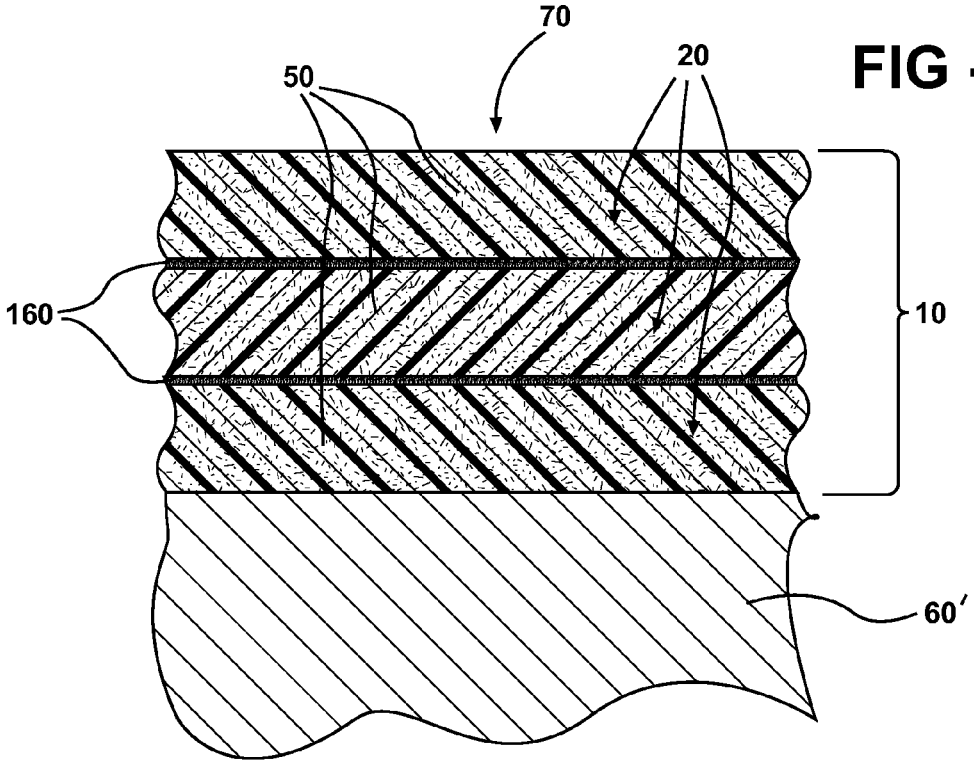
FIG. 7 is a cross-section view illustrating an armored article comprising multi-layer articles of armor.

Referring to FIGS. 7 and 11, the method 500 may also include an additional step of laminating 545 a plurality of layers of the friction material to one another to produce laminated article 10 of armor 20. This may be performed simply to form a sheet, plate or other form of friction material having a thickness greater than the individual layer or ply thicknesses. Since the polymerization reaction used to form the friction material is temperature dependent, in some applications it may be desirable to form the friction material in thinner sheets to promote faster curing and cycle times in the equipment used to cure the friction material, and then to laminate a plurality of sheets together to form the desired overall thickness of the friction material. This may include all manner of batch or continuous lamination processes, including various automated lamination processes, such as might be utilized in a manufacturing facility and involve the application of an elevated temperature or pressure during lamination, as well as all manner of manual lamination processes, including those which are done by hand without the application of an elevated temperature or pressure. Alternately, laminating may be employed as a step used in conjunction with forming an armor preform 515, such as by combining a plurality of sheets of an armor preform 525 to form armor 20. Lamination may employ the addition of various means for joining adjacent layers 160, such as the use of adhesive materials between the layers and the like. Any suitable adhesive material compatible with the desired application may be employed, including various adhesives which are currently used to bond friction materials to themselves or to backing plates or other members, such as liquid phenolic resin based adhesives, such as Plastilok brand adhesive. It is also believed that the adhesive material may include the resin material used to form the friction material, and that in some cases it may be applied to the surfaces to be bonded, cured or polymerized by the application of temperature and pressure to form an effective adhesive for lamination. It is also believed that lamination may be effective if the friction material 50 exhibits anisotropic characteristics (e.g., if the forming step has a tendency to orient the fibers or other constituents of the pre-polymer friction material in a particular preferred direction or orientation during polymerization), such as anisotropy with respect to its morphology or mechanical properties, to either amplify or attenuate such characteristics by forming the laminate so as to take into consideration these characteristics for the desired application. For example, if it is desired to amplify the effect of anisotropy, it may be desirable to stack the layers of the laminate so that the various layers have the anisotropic characteristic aligned in a particular direction or orientation. If it is desired to attenuate the anisotropy, it may be desirable to stack the layers with the anisotropy intentionally misaligned which will tend to produce an overall friction material with diminished anisotropic characteristics or behavior.

The method may also include an additional step of attaching 560 a layer or a plurality of layers of the friction material 50 as armor 20 to a surface of an article to be armored 60' that is adapted and operative to receive a polymerized friction material. This step may include attaching the friction material to a portion 72 of the surface of the article 60' or over the entire surface of the article (See FIG. 7). For example, the friction material 50 as an armor 20 may be attached so as to completely encase the article to be armored. Alternately, the friction material 50 as an armor 20 may be attached to cover only a portion 72 of the surface of the article to be armored, such as in the case of attaching the friction material 50 as a backing or facing layer to an article comprising a flat or formed sheet. It is believed that the step of attaching 560 may be performed using any suitable means and method of attachment. The means of attachment may include any of a number of chemical fasteners, such as adhesives, glues, pastes, mortars, cements, chemical welds and the like; mechanical fasteners, such as various threaded fasteners (i.e., all manner of screws, threaded bolts and/or nuts), rivets, stakes, camming fasteners, clamps, clips, backing plates, ratcheting or zip ties; and interlocking features for interlocking the friction material to the article to be armored 60', or to other armored articles 10, or to a separate article that is adapted to interlock the friction material to the article to be armored, such as various types of slots, hole/joining pin combinations, pockets, male/female interlocking members and the like.

In order to demonstrate the suitability of the friction material 50 as an article 10 of armor 20, test coupons of the armor 20 were made using a representative friction material formulation in accordance with the method described herein and then subjected to ballistic impact testing using a variety of ballistic projectiles. The results are reported below as several representative examples.

Example 1

A first friction material formulation which included as constituents a resin binding agent, a fibrous material as a support structure, a friction modifier or modifying system and a filler as a wear system was used to make a number of test coupons of friction armor 20. The resin binding agent was a powdered phenolic resin. The fibrous material was a mixture of glass fibers. The friction modifying system included rubber particles, cashew friction particles, graphite and petroleum coke. The filler as a wear system included barytes, a small amount of steel fibers, carbon black and brass chips. The coupons were made by mixing a total of 60 lbs. of the friction material constituents for 14 minutes in a Littleford mixer to form the pre-polymer friction material. The pre-polymer friction material was processed by hot forming for an interval of 12 minutes at a temperature of 330° F. The finished test coupons were 0.75×6×6 inches. Final curing and polymerization was accomplished by heating the coupons in an electric oven for 8 hours at 300° F. The coupons had a Gogan C scale hardness of 20-28 GC. Each test coupon was subjected to a number of ballistic firing tests by firing 14 rounds of ammunition of a given caliber, projectile configuration (i.e., bullet diameters, materials, constructions and weights) and velocities into the test coupon from a distance of 21 feet. Projectiles 30 having a number of different calibers and weights were tested. During each test, the test coupon was positioned upon a target stand of 0.75 inch plywood and fastened with adhesive to the face of the test stand so that the test coupon was facing the gun used to fire the rounds. The results of the tests were assessed on a pass/fail basis, with the criterion for passing the test being 1) no penetration of any projectile through the thickness of the test coupon, and 2) that the coupon maintain its overall structural integrity as one piece. By structural integrity, it is meant that surface cracking, spalling and ablation is permitted and constitutes a "pass", but cracking through the thickness of the coupon sufficient to actually or substantially sever a piece of the coupon would constitute a "fail". The results are reported in Table 1 below:

TABLE 1

| Coupon No. | Bullet Caliber and Type | Weight (grains) | Muzzle Velocity (ft/sec) | Distance To Target (ft) | Number Of Impacts | Pass/Fail |
|---|---|---|---|---|---|---|
| 1 | 0.44 magnum | 180 | 1460 | 21 | 14 | Pass |
| 2 | 0.45 ACP | 220 | 1055 | 21 | 14 | Pass |
| 3 | 0.45 SXT | 180 | 1155 | 21 | 14 | Pass |
| 4 | 0.40 | 180 FMJ | 1205 | 21 | 14 | Pass |
| 5 | 0.40 SXT | 180 FMJ | 1260 | 21 | 14 | Pass |
| 6 | 9 mm | 124 FMJ RN | 1430 | 21 | 14 | Pass |
| 7 | 9 mm SXT | 140 | 1430 | 21 | 14 | Pass |
| 8 | 7.62 NATO | 148 FMJ | 2780 | 21 | 14 | Pass |
| 9 | 7.62 × 39 | 135 FMJ | 2860 | 21 | 14 | Pass |
| 10 | .30-06 (.30) | 166 | 2880 | 21 | 14 | Pass |
| 11 | 0.357 magnum | 158 JST | 1430 | 21 | 14 | Pass |
| 12 | 0.50 SXT | 280/300 | 2370 | 21 | 9 | Pass |

As may be seen, all of the samples of the first friction formulation passed the test. This example demonstrates the effectiveness of a friction material 50 composition as armor 20 against a range of common small caliber ammunition as set forth herein. It further demonstrates the ability of armor 20 to resist penetration by a plurality of ballistic projectiles 30 incident at a single point of impact, or a small area of impact.

Example 2

A second friction material formulation which also included as constituents a resin binding agent, a fibrous material as a support structure, a friction modifier or modifying system and a filler as a wear system was used to make a number of test coupons of friction material armor. The resin binding agent was a powdered phenolic resin. The fibrous material was a glass fiber material. The friction modifying system included rubber particles and cashew friction particles. The filler or wear system included calcium carbonate, barytes and carbon black. The coupons were made by mixing a total of 65 lbs. of the friction material constituents for 14 minutes in a Littleford mixer to form the pre-polymer friction material. The pre-polymer friction material was processed by the step of hot forming for an interval of 15 minutes at a temperature of 330° F. The finished test coupons were 0.75×6×6 inches. The coupons had a Gogan C scale hardness of 25 to 30 GC. Each test coupon was subjected to a number of ballistic firing tests by firing 14 rounds of ammunition of a given caliber and projectile configuration and velocities (i.e., bullet diameters, materials, constructions and weights) into the test coupon from a distance of 21 feet. Projectiles having a number of different calibers and weights were tested. During each test, the test coupon was positioned upon a target stand of 0.75 inch plywood and fastened with adhesive to the face of the test stand so that the test coupon was facing the gun used to fire the rounds. The results of the tests were assessed on a pass/fail basis, with the criterion described above. The results are reported in Table 2 below:

TABLE 2

| Coupon No. | Caliber | Weight (grains) | Muzzle Velocity ft/sec | Distance To Target (ft) | Number Of Impacts | Pass/Fail |
|---|---|---|---|---|---|---|
| 1 | 0.44 magnum | 180 | 1460 | 21 | 14 | Pass |
| 2 | 0.45 ACP | 220 | 1055 | 21 | 14 | Pass |
| 3 | 0.45 SXT | 180 | 1155 | 21 | 14 | Pass |
| 4 | 0.40 | 180 FMJ | 1205 | 21 | 14 | Pass |
| 5 | 0.40 SXT | 180 FMJ | 1260 | 21 | 14 | Pass |
| 6 | 9 mm | 124 FMJ RN | 1430 | 21 | 14 | Pass |
| 7 | 9 mm SXT | 140 | 1430 | 21 | 14 | Pass |
| 8 | 7.62 NATO | 148 FMJ | 2780 | 21 | 14 | Pass |
| 9 | 7.62 × 39 | 135 FMJ | 2860 | 21 | 14 | Pass |
| 10 | .30-06 (.30) | 166 | 2880 | 21 | 14 | Pass |
| 11 | 0.357 magnum | 158 JST | 1430 | 21 | 14 | Pass |
| 12 | 0.50 SXT | 280/300 | 2370 | 21 | 9 | Pass |

As may be seen, all of the samples of the second friction formulation passed the test. This example demonstrates the effectiveness of another friction material 50 composition as armor 20 against a range of common small caliber, and is indicative that friction materials are generally effective for use as armor 20 in the manner and to the extent set forth herein.

In addition, it is also believed that articles 10 of armor 20 may be effective against larger caliber rounds, such as 25 mm and larger rounds, rocket propelled grenades, certain anti-armor rounds and the like with appropriate scaling of the thickness and other aspects of armor 20.

While the particular mechanisms by which friction material 50 resists penetration from ballistic projectiles so as to act as armor 20 are not fully known, it is believed that the controlled friction characteristics of friction material 50 play a significant role in providing such resistance.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. An article of armor, comprising a polymerized mixture of:

5 to 30 percent by weight of a resin binder agent, the resin binder agent including powdered phenolic resin;

10 to 50 percent by weight of fibers having a length of 0.5 inches or less, the fibers including glass fibers;

0.5 to 40 percent by weight of a friction modifier, the friction modifier including rubber particles, cashew friction particles, graphite, and petroleum coke;

10 to 40 percent by weight of a filler, the filler including barytes, steel fibers, carbon black, and brass chips;

wherein the resin binder agent forms a polymer matrix binding together the fibers, the friction modifier and the filler so that the fibers have a discontinuous, random orientation in the polymer matrix; and the polymerized mixture has a density of 1.85-2.5 g/cm$^3$.

2. The article of armor of claim 1, further comprising at least one of a backing or facing.

3. The article of claim 2, wherein said backing comprises a metal.

4. The article of claim 2, wherein said backing comprises a non-metal.

5. The article of claim 2, further comprising a means for attaching said polymerized mixture and said backing to one another.

6. The article of armor of claim 5, wherein said means for attaching comprises at least one of a joining mechanism and a joining material.

7. The article of armor of claim 1, wherein said polymer matrix is a cross-linked polymer matrix.

8. The article of armor of claim 7, wherein said cross-linked polymer matrix includes at least one thermoset polymer.

9. The article of armor of claim 7, wherein said cross-linked polymer matrix includes at least one thermoplastic polymer.

10. The article of armor of claim 1, wherein said resin binder agent further comprises at least one resin selected from the group consisting of epoxy, condensed poly-nuclear aromatic, cyanate ester, melamine, melamine-formaldehyde, urea-formaldehyde, resorcinol-formaldehyde, polyurethane, polyalkyd, silicone, polyester, acrylic, furan and polyimide resins.

11. The article of armor of claim 1, wherein said fibers further comprise at least one fiber selected from the group consisting of metal, glass, mineral, carbon, polymer and ceramic fibers.

12. The article of armor of claim 1, wherein said friction modifier further comprises at least one friction modifier selected from the group consisting of metal sulfides, cashew shells, metals, metal oxides, metal carbides and metal silicates.

13. The article of armor of claim 1, wherein said filler further comprises at least one filler selected from the group consisting of barium sulfate, calcium carbonate, magnesium silicate, magnesium carbonate, mica, alkali metal titanates, vermiculite, molybdenum trioxide, cashew dust, rubber dust and clay.

14. The article of armor of claim 10, wherein said resin binder agent comprises at least one resin selected from the group consisting of condensed poly-nuclear aromatic, melamine, melamine-formaldehyde, urea-formaldehyde, resorcinol-formaldehyde, polyalkyd, silicone, polyester, furan and polyimide resins.

15. The article of armor of claim 11, wherein said fibers comprise at least one fiber selected from the group consisting of metal, mineral, carbon and ceramic fibers.

16. The article of armor of claim 12, wherein said friction modifier comprises at least one friction modifier selected from the group consisting of metal sulfides, cashew shells, metals, metal oxides and metal carbides.

17. An article of armor, comprising a polymerized mixture of:

5 to 30 percent by weight of a resin binder agent, the resin binder agent including powdered phenolic resin;

10 to 50 percent by weight of fibers having a length of 0.5 inches or less, the fibers including glass fibers;

0.5 to 40 percent by weight of a friction modifier, the friction modifier including rubber particles and cashew friction particles;

10 to 40 percent by weight of a filler, the filler including calcium carbonate, barytes, and carbon black;

wherein the resin binder agent forms a polymer matrix binding together the fibers, the friction modifier and the filler so that the fibers have a discontinuous, random orientation in the polymer matrix; and the polymerized mixture has a density of 1.85-2.5 g/cm$^3$.

18. The article of armor of claim 17, further comprising at least one of a backing or facing.

19. The article of claim 18, wherein said backing comprises a metal.

20. The article of claim 18, wherein said backing comprises a non-metal.

21. The article of claim 18, further comprising a means for attaching said polymerized mixture and said backing to one another.

22. The article of armor of claim 21, wherein said means for attaching comprises at least one of a joining mechanism and a joining material.

23. The article of armor of claim 17, wherein said polymer matrix is a cross-linked polymer matrix.

24. The article of armor of claim 23, wherein said cross-linked polymer matrix includes at least one thermoset polymer.

25. The article of armor of claim 23, wherein said cross-linked polymer matrix includes at least one thermoplastic polymer.

26. The article of armor of claim 17, wherein said resin binder agent further comprises at least one resin selected from the group consisting of epoxy, condensed poly-nuclear aromatic, cyanate ester, melamine, melamine-formaldehyde, urea-formaldehyde, resorcinol-formaldehyde, polyurethane, polyalkyd, silicone, polyester, acrylic, furan and polyimide resins.

27. The article of armor of claim 17, wherein said friction modifier further comprises at least one friction modifier selected from the group consisting of graphites, metal sulfides, cashew shells, metals, metal oxides, metal carbides and metal silicates.

28. The article of armor of claim 17, wherein said filler further comprises at least one filler selected from the group consisting of barium sulfate, magnesium silicate, magnesium carbonate, mica, alkali metal titanates, vermiculite, molybdenum trioxide, cashew dust, rubber dust and clay.

* * * * *

UNITED STATES PATENT AND TRADEMARK OFFICE

CERTIFICATE OF CORRECTION

PATENT NO. : 8,689,671 B2
APPLICATION NO. : 11/862441
DATED : April 8, 2014
INVENTOR(S) : Hummel et al.

Figure 6A:
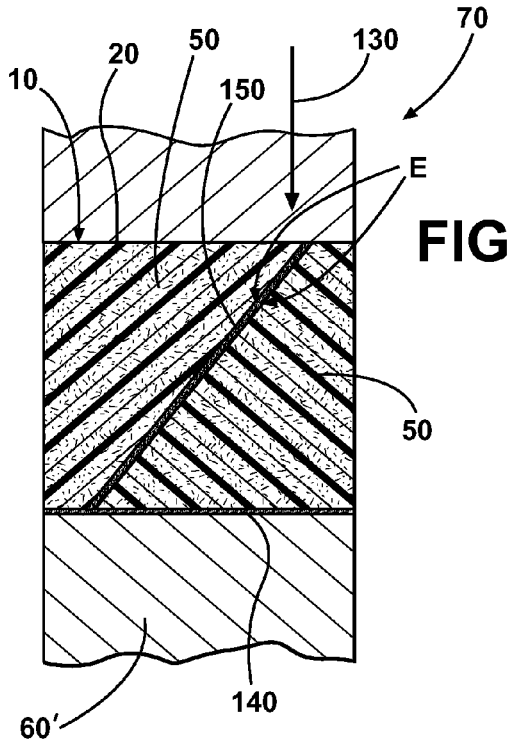
FIGS. 6 A-D are cross-section views of armored articles formed by joining articles of armor using various joint configurations.
Figure 6B:
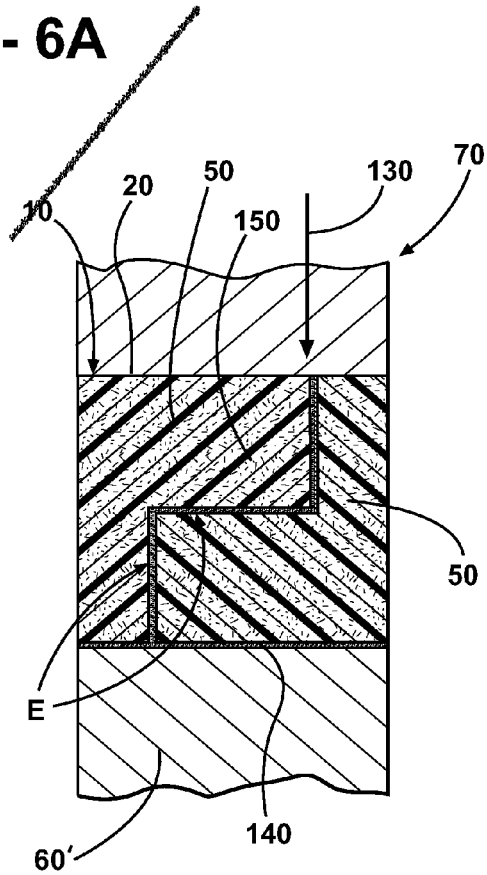
Figure 6C:
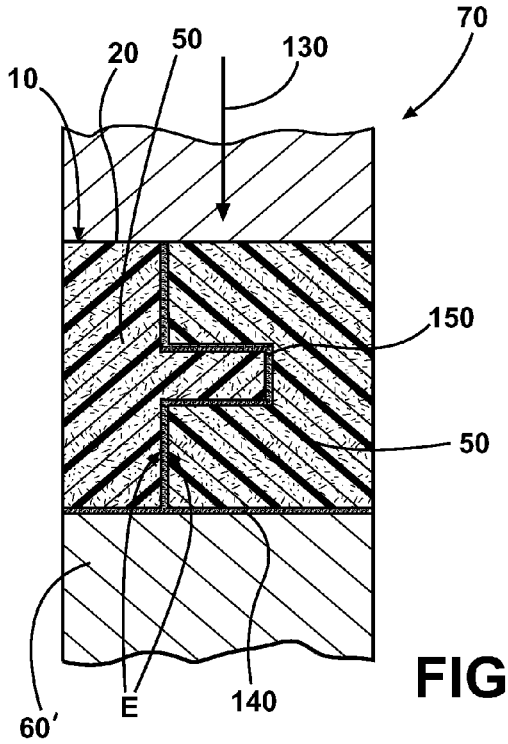
Figure 6D:
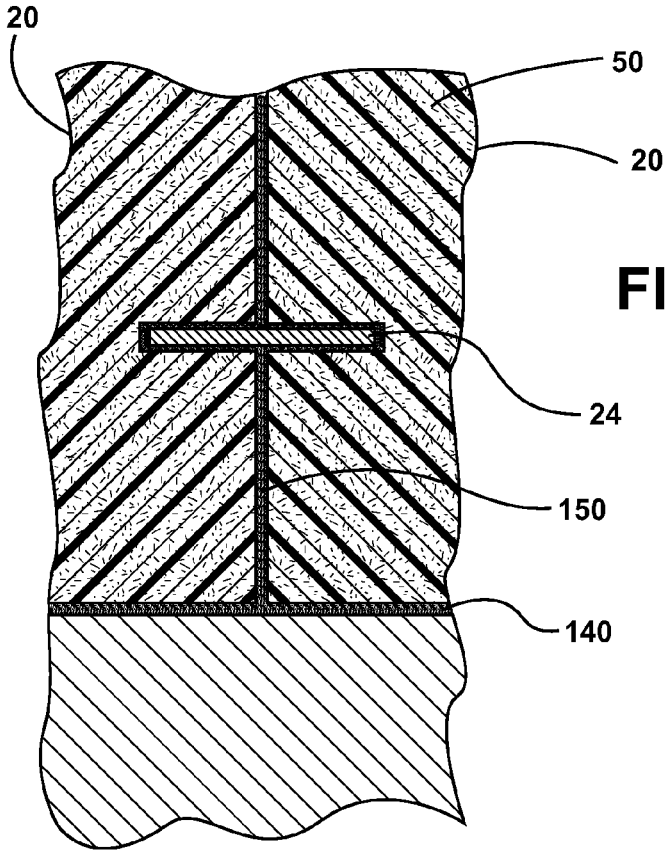

It is certified that error appears in the above-identified patent and that said Letters Patent is hereby corrected as shown below:

In the drawings:

Drawing sheet 4 of 8, FIG - 6B Line covering drawing reference number 10 should be deleted.

Signed and Sealed this
Twenty-ninth Day of July, 2014

Michelle K. Lee

Michelle K. Lee
*Deputy Director of the United States Patent and Trademark Office*